US008794177B2

(12) United States Patent
Shigekura et al.

(10) Patent No.: US 8,794,177 B2
(45) Date of Patent: Aug. 5, 2014

(54) COATING METHOD AND COATING APPARATUS

(75) Inventors: Masaki Shigekura, Tochigi (JP); Kohei Ogata, Tochigi (JP); Gaku Kawabe, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/547,588

(22) Filed: Jul. 12, 2012

(65) Prior Publication Data

US 2013/0040064 A1 Feb. 14, 2013

(30) Foreign Application Priority Data

Aug. 12, 2011 (JP) ..... 2011-176603
Aug. 12, 2011 (JP) ..... 2011-176878

(51) Int. Cl.

| | |
|---|---|
| ***B05C 5/02*** | (2006.01) |
| ***B05B 5/04*** | (2006.01) |
| ***B05B 3/10*** | (2006.01) |
| ***B05B 3/02*** | (2006.01) |

(52) U.S. Cl.

CPC ..... *B05B 5/0407* (2013.01); *B05B 5/0426* (2013.01); *B05B 3/1014* (2013.01); *B05B 3/02* (2013.01); *B05B 5/02* (2013.01)

USPC ..... 118/323; 118/629; 239/700; 239/703; 239/704; 239/706; 239/708; 239/224

(58) Field of Classification Search

CPC .. B05B 5/0407; B05B 5/0426; B05B 3/1014; B05B 3/02; B05C 5/02

USPC ..... 118/629, 323; 239/699–708, 224

See application file for complete search history.

(56) References Cited

U.S. PATENT DOCUMENTS

| | | | | |
|---|---|---|---|---|
| 4,370,538 | A * | 1/1983 | Browning | 219/121.59 |
| 6,745,948 | B1 * | 6/2004 | Hidaka et al. | 239/8 |
| 7,341,763 | B2 * | 3/2008 | Miyamoto et al. | 427/449 |

FOREIGN PATENT DOCUMENTS

| | | | |
|---|---|---|---|
| CN | 101573184 | A | 11/2009 |
| JP | 60-54754 | A | 3/1985 |
| JP | 08-084941 | * | 4/1996 |
| JP | 09-085134 | * | 3/1997 |
| JP | 2002-224611 | | 8/2002 |
| JP | 2009-072703 | A | 4/2009 |

OTHER PUBLICATIONS

English Translation of JP-08-084941 (Kohari et al) Published Apr. 1996.*

English Translation of JP-09-085134 (Kohari et al) Published Mar. 1997.*

Chinses Office Action dated Jan. 30, 2014; Issued over Chinese Patent Application No. 201210286583.X.

* cited by examiner

*Primary Examiner* — Laura Edwards
(74) *Attorney, Agent, or Firm* — Arent Fox LLP

(57) ABSTRACT

A coating apparatus has a rotary atomizing head that discharges paint to a work, and an air injecting unit that injects annular shaping air towards an outer peripheral edge portion of the rotary atomizing head. The air injecting unit has first air injecting ports and second air injecting ports. First air of relatively high wind speed is injected from the first air injecting ports and second air of relatively low wind speed is injected from the second air injecting ports.

10 Claims, 15 Drawing Sheets

210

COATING METHOD AND COATING APPARATUS

BACKGROUND OF THE INVENTION

1. Field of the Invention

The present invention relates to a coating method and a coating apparatus of spraying a liquid paint from a rotary atomizing head and thus performing an electrostatic coating.

2. Related Art

As a coating apparatus of coating a body of an automobile and the like, a rotary atomization coating apparatus has been known. In the rotary atomization coating apparatus, a high voltage is applied to a rotary atomizing head that is rotating, and at this state, a conductive paint (liquid paint) is supplied to the rotating rotary atomizing head. Thereby, the liquid paint is electrified and atomized and is then sprayed from a front end edge of the rotary atomizing head, so that an electrostatic coating is performed.

Regarding the rotary atomization coating apparatus, JP-A-60-054754 discloses that air injecting ports for pattern deformation are provided only at upper and lower parts or left and right parts so as to remove lowering of a coating efficiency or deviation of a coating film thickness due to a coating pattern having a doughnut shape, a coating pattern is deformed to an elliptical shape by air for pattern deformation and a coating film thickness is thus made to be uniform.

However, in the elliptical coating pattern, upper, lower, left and right coating areas are different. When the coating is performed in the upper-lower direction, and when the coating is performed in the left-right direction, the coating film thickness is not the same. Therefore, moving (teaching) of a coating gun for uniformly recoating a coating pattern is highly limited.

Also, it is considered to remove the doughnut shape by increasing an inclined angle of annular shaping air to a direction of a rotational shaft, compared to a usual case. In this case, however, a diameter of the coating pattern is decreased, so that the coating efficiency is lowered. Also, an air ring that is a member for injecting the shaping air is enlarged, so that a robot operation is restricted.

JP-A-2009-072703 discloses that an amount of air injection from an air injecting port is controlled so as to securely apply paint to a work (object to be painted) having a complicated shape, thereby changing a coating pattern diameter.

In the coating by the rotary atomization coating apparatus, the paint is generally sprayed with the coating gun being perpendicular to a part to be painted of the work, i.e., a rotational axis of a rotary atomizing head configuring the coating gun being arranged to be substantially perpendicular to the part to be painted, considering the coating efficiency.

However, when coating an inner plate and the like of an automobile, the coating may be performed with the coating gun being obliquely arranged relative to the part to be painted, not perpendicularly thereto, so as to avoid an interference of the coating gun with the work. In this case, since the recoating is performed using an end portion of a coating pattern having a small amount of coating, the coating efficiency is lowered.

SUMMARY OF THE INVENTION

Exemplary embodiments relate to a coating method and a coating apparatus capable of reducing a non-coated part, which is caused in the vicinity of a rotational axis of a rotary atomizing head, and obtaining a coating film having a uniform film thickness without enlarging a member for injecting shaping air while securing a degree of freedom of moving of a coating gun when recoating a coating pattern.

In addition, exemplary embodiments relate to a coating method and a coating apparatus capable of effectively performing a coating even when the coating is performed with a coating gun being obliquely arranged relative to a part to be painted.

DETAILED DESCRIPTION OF THE EMBODIMENTS

Hereinafter, exemplary embodiments and modifications relating to a coating apparatus and a coating method will be described with reference to the accompanying drawings. It should be noted that the exemplary embodiments and modifications described herein are not intended to limit the invention but only to exemplify the invention, and all features or combinations of the features of the exemplary embodiments and modifications are not always essential to the invention.

First Exemplary Embodiment

Figure 1:
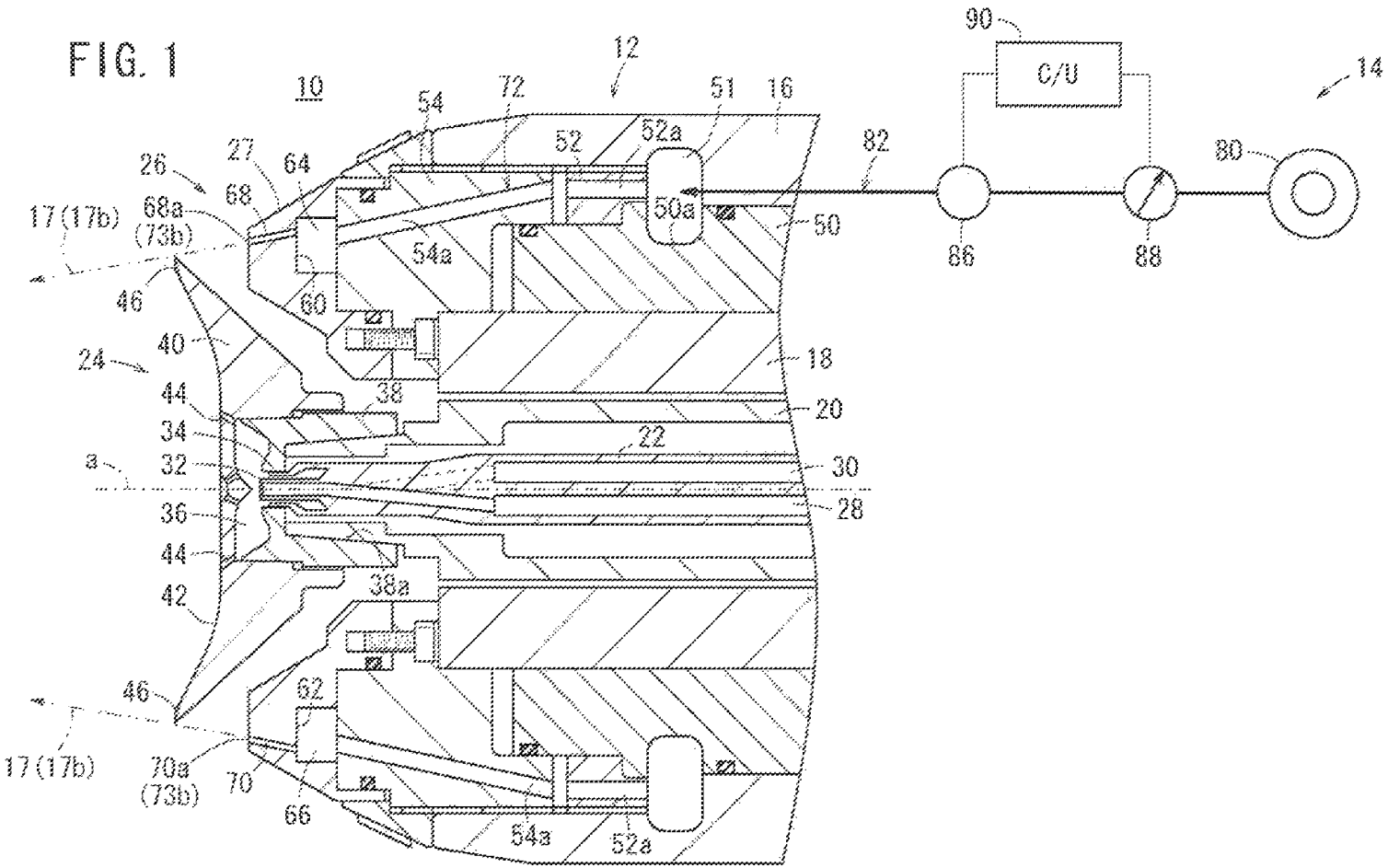
FIG. 1 shows a schematic configuration of a coating apparatus according to a first exemplary embodiment.

FIG. 1 shows a schematic configuration of a coating apparatus 10 according to a first exemplary embodiment. As shown in FIG. 1, the coating apparatus 10 has at least a coating gun 12 that configures a main body of the apparatus, and an air supplying system 14 that supplies air for shaping air 17 to the coating gun 12.

The coating gun 12 has a casing 16 (housing), an air motor 18 installed in the casing 16, a hollow rotational shaft 20 rotating at high speed by the air motor 18, a conduit 22 insertion-penetrating into a hollow portion of the rotational shaft 20, a bell shaped rotary atomizing head 24 installed at a front end of the rotational shaft 20, and an air injecting unit 26 that injects the shaping air 17 towards an outer peripheral edge of a front end of the rotary atomizing head 24.

The air motor 18 is supplied with compressed air from a compressed air supplier (not shown) to thereby rotate the rotational shaft 20 at high speed. The rotational shaft 20 is connected to a high voltage generator (not shown) for generating a high voltage. Accordingly, the rotary atomizing head 24 is applied with a highly negative voltage through the rotational shaft 20. Also, the rotational shaft 20 is a hollow cylindrical member and the conduit 22 is disposed in the hollow portion thereof.

The conduit 22 is formed therein with a paint supplying channel 28 for supplying paint and a cleaning solution supplying channel 30 for supplying a cleaning solution. A front end portion of the conduit 22 is formed in a dual pipe shape, and a paint supplying nozzle 32 for discharging paint and a cleaning solution supplying nozzle 34 for discharging a cleaning solution are concentrically formed.

The rotary atomizing head 24 is fixed to the front end of the rotational shaft 20. When the rotational shaft 20 rotates during the operation of the air motor 14, the rotary atomizing head 24 also rotates integrally together with the rotational shaft 20. The rotary atomizing head 24 is formed therein with a paint storage 36 for temporarily storing paint supplied through the conduit 22. The paint storage 36 is a circle shaped space. The paint supplying nozzle 32 directs towards a centric portion of the paint storage 36.

The rotary atomizing head 24 is formed of an inner member 38 fixed to the rotational shaft 20 and a bell cup 40 fixed to an outer peripheral portion of the inner member 38. The paint storage 36 is formed between the inner member 38 and the bell cup 40. The inner member 38 is formed therein with a concave portion 38*a* into which a front end portion of the rotational shaft 20 is fitted. The inner member 38 is formed at a front centric portion thereof with an opening into which a front end portion of the conduit 22 insertion-penetrates.

The bell cup 40 has a circular cup shape that is enlarged outwards in a radial direction and towards its front direction. The bell cup 40 is formed at a front face thereof with a paint discharging face 42 thinning paint supplied to the front face. The paint discharging face 42 is inclined in a front direction and outwards in a radial direction, is doughnut-shaped when viewed from its front side, and serves to thin paint from the paint storage 36 due to the centrifugal force resulting from the rotation of the bell cup 40.

The bell cup 40 is provided with a plurality of paint supplying holes 44 for supplying paint to the paint discharging face 42, which are formed at an equal interval along the circumferential direction a center of which is positioned on a rotational axis "a" of the rotary atomizing head 24. Each of the paint supplying holes 44 is inclined in far direction from the axial line "a" of the rotary atomizing head 24 towards the front of the rotary atomizing head 24, and is opened at its one end (inner side end) in the paint storage 32 and opened at its other end (outer side end) in the front face of the bell cup 40.

A rear centric portion of the bell cup 40 is configured to protrude towards an inner side (the conduit 22 side) of the paint storage 36 and to distribute the supplied paint or cleaning solution to the outer side thereof in a radial direction.

A plurality of grooves 46 for injecting paint as liquid threads is arranged at an equal interval in a circumferential direction on a front side outer peripheral edge portion of the bell cup 40 (i.e., the outer peripheral edge portion of the paint discharging face 42). The respective grooves 46 are provided at an equal interval throughout the outer peripheral edge portion of the paint discharging face 42 and extended along the radial direction of the rotary atomizing head 24, and serve to subdivide a thin film shaped paint flowing towards the outer side thereof in a radial direction along the paint discharging face 42. Thereby, thin thread shaped paint (liquid thread) is discharged from the outer peripheral end portion of the bell cup 40.

A plurality of ring-shaped flow path forming members 50, 52, 54 (three, in the shown example) is disposed between the casing 16 and the air motor 18. Hereinafter, the flow path forming members 50, 52, 54 are referred to as 'first flow path forming member 50', 'second flow path forming member 52' and 'third flow path forming member 54', respectively. The first flow path forming member 50 is disposed at the outside of the air motor 18 and is formed at an outer peripheral portion thereof with an annular concave portion 50*a*.

The second flow path forming member 52 is disposed between the first flow path forming member 50 and the casing 16 and is provided with a plurality of flow paths 52*a* penetrating in an axial line direction, which are formed at an interval in a circumferential direction. An annular space 51 is formed by the first flow path forming member 50, the second flow path forming member 52 and the casing 16. The third flow path forming member 54 is disposed between the casing 16 and the first flow path forming member 50 and also at the front of the first flow path forming member 50 and the second flow path forming member 52. The third flow path forming member 54 is provided with a plurality of flow paths 54*a*, which communicate with the flow paths 52*a* of the second flow path forming member 52 and are formed at an interval in a circumferential direction.

A ring member 27 configuring the air injecting unit 26 is fixed to a front end of the third flow path forming member 54 concentrically with the bell cup 40 so that it surrounds the bell cup 40 at the rear side of the bell cup 40. The ring member injects the shaping air 17 from the rear of an outer peripheral edge portion of the bell cup 40 towards the outer peripheral edge portion.

Figure 2:
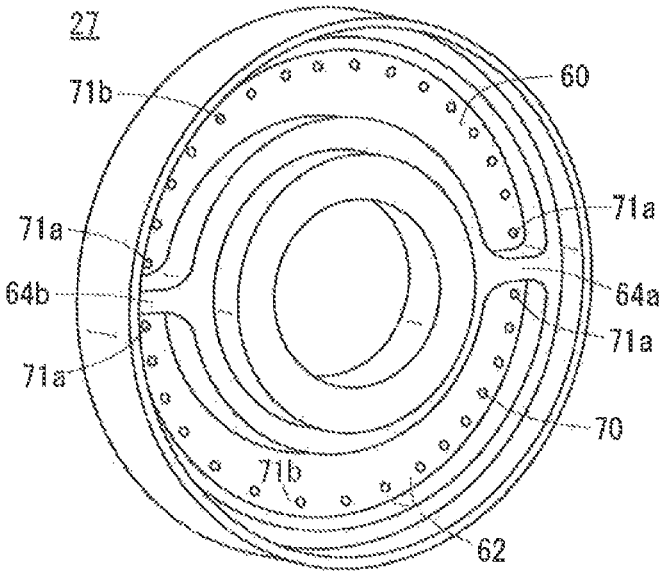
FIG. 2 is a perspective view showing a backside of a ring member of the coating apparatus shown in FIG. 1.

FIG. 2 is a perspective view of the ring member 27, when seen from a backside thereof. As shown in FIGS. 1 and 2, the ring member 27 is formed at its backside with a first arc-shaped concave portion 60 and a second arc-shaped concave portion 62. The first arc-shaped concave portion 60 and the second arc-shaped concave portion 62 are partitioned by partition walls 64*a*, 64*b* and have the substantially same volume. A first arc-shaped buffer chamber 64 is formed by the first arc-shaped concave portion 60 and a front face of the third flow path forming member 54. A second arc-shaped buffer chamber 66 is formed by the second arc-shaped concave portion 62 and the front face of the third flow path forming member 54.

As shown in FIG. 1, the ring member 27 is further formed with a plurality of air supplying holes 68 communicating the first buffer chamber 64 with a front face of the ring member 27 and a plurality of air supplying holes 70 communicating the second buffer chamber 66 with the front face of the ring member 27. The air supplying hole 68 is opened at its one end (rear end) in the first buffer chamber 64 and is opened at its other end (front end) as an air injecting port 68*a* in the front face. The air supplying hole 70 is opened at its one end (rear end) in the second buffer chamber 66 and is opened at its other end (front end) as an air injecting port 70*a* in the front face.

The air supplying holes 68 and the air supplying holes 70 are respectively provided at an equal interval in a circumferential direction about the axial line "a", are inclined to be close to the axial line "a" of the rotary atomizing head 24 towards the front and are opened towards the outer peripheral edge portion of the bell cup 40. Also, the air supplying holes 68, 70 are inclined relative to the axial line "a" by a predetermined angle (for example, 30 to 50 degrees) in the circumferential direction a center of which is positioned on the axial line "a" of the rotary atomizing head 24.

Figure 3A:
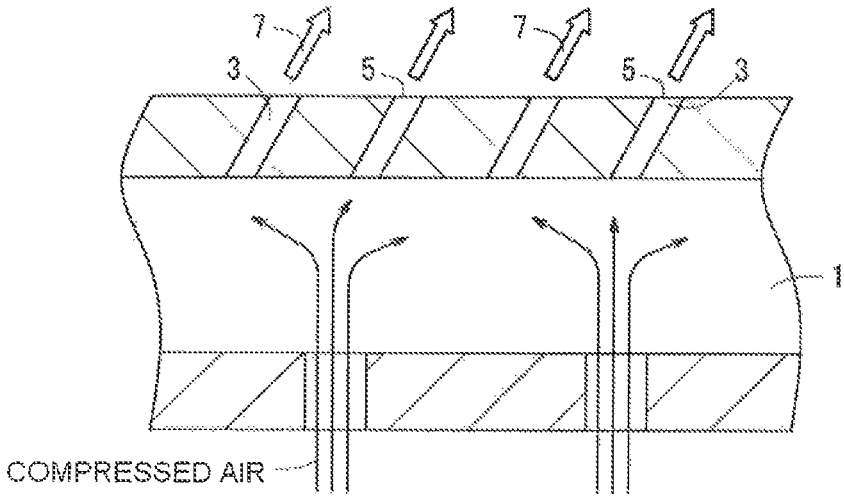
FIG. 3A is a pictorial view showing air flow in a buffer chamber when there is no partition wall.
Figure 3B:
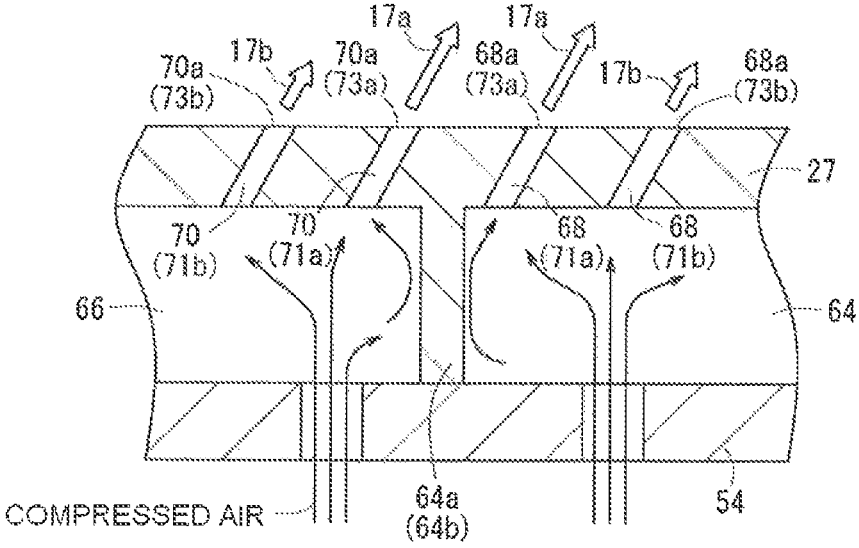
FIG. 3B is a pictorial view showing air flow in a buffer chamber when a partition wall is provided.

Among the air supplying holes 68, 70, the holes that are disposed in the vicinity of the partition walls are referred to as 'first air supplying holes 71*a*' (refer to FIGS. 2 and 38), and the holes that are disposed at positions (positions between the first air supplying holes close to both ends in each of the first buffer chamber 64 and the second buffer chamber 66) distant from the partition walls in the circumferential direction that the first air supplying holes 71*a* are referred to as 'second air supplying holes 71*b*' (refer to FIGS. 2 and 3B). Also, among the air injecting ports 68*a*, 70*a*, the ports corresponding to the first air supplying holes 71*a* are referred to as 'first air injecting ports 73*a*' (refer to FIG. 38) and the ports corresponding to the second air supplying holes 71*b* are referred to as 'second air injecting ports 73*b*' (refer to FIGS. 1 and 38).

In the coating gun 12 shown in FIG. 1, an air supplying channel 72 for supplying compressed air from the air supplying system 14 to the ring member 27 is configured by the annular space 51, the plurality of flow paths 52*a* of the second flow path forming member 52 and the plurality of flow paths 54*a* of the third flow path forming member 54.

As shown in FIG. 1, the air supplying system 14 has an air supplier 80 and an air line 82 that guides the compressed air from the air supplier 80 to the coating apparatus 12. The air supplier 80 is an air pump, for example, and delivers the compressed air. The air line 82 supplies the compressed air to the annular space 51. The air line 82 is provided thereon with a flow meter 88 and an electro-pneumatic converter 86. An air control unit 90 controls the electro-pneumatic converter 86 so that a flow rate of the air to be supplied to the air supplying channel 72 becomes a predetermined flow rate, by using a flow rate value detected in the flow meter 88 as a feedback value.

The compressed air that is supplied to the coating gun 12 by the air line 82 of the air supplying system 14 is circumferentially diffused in the annular space 51, sequentially passes through the flow paths 52*a* and the flow paths 54*a* and then flows into the first buffer chamber 64 and the second buffer chamber 66. The compressed air passes through the air supplying holes 68, 70 in each of the first buffer chamber 64 and the second buffer chamber 66 and is then injected from the air injecting ports 68*a*, 70*a*.

In this case, first air 17*a*, which is injected from the first air injecting ports 73*a* that are outlets of the first air supplying holes 71*a* arranged in the vicinity of the partition walls 64*a*, 64*b*, is air of relatively high wind speed configuring predetermined portions of the shaping air 17 in a circumferential direction. On the other hand, second air 17*b*, which is injected from the second air injecting ports 73*b* that are outlets of the second air supplying holes 71*b* arranged at the positions more distant from the partition walls 64*a*, 64*b* in the circumferential direction than the first air supplying holes 71*a*, is air of relatively low wind speed configuring other portions of the shaping air 17 in the circumferential direction. That is, the wind speed (flow speed) of the first air 17*a* is higher than the wind speed (flow speed) of the second air 17*b*. The reason that the first air 17*a* injected from the first air injecting ports 73*a* has the higher wind speed than that of the second air 17*b* injected from the second air injecting ports 73*b* will be described later.

The coating apparatus 10 of the first exemplary embodiment is configured as described above. In the below, the operations and effects thereof are described.

During painting, the rotational shaft 20 is rotated at high speed by the air motor 18. And, paint is discharged towards the paint storage 36 of the rotary atomizing head 24 from the paint supplying nozzle 32. Thereby, the paint having flowed into the paint storage 36 flows into the paint supplying holes 44. In this case, the paint passing through the paint supplying holes 44 is discharged onto the paint discharging face 42 and thinned thereon, and thereafter, subdivided in the grooves 46 to be discharged as liquid threads from the outer peripheral end of the bell cup 40. The liquid threads discharged from the outer peripheral end of the bell cup are atomized as paint particles.

At this time, since a high voltage is applied between the rotary atomizing head 24 and a work (object to be painted), the electrified paint particles having been atomized by the rotary atomizing head 20 fly towards the work to coat the work. The sprayed pattern of the paint at this time is pattern-molded by the shaping air 17 (first air 17*a* and second air 17*b*) being injected from the air injecting ports.

Compared to the configuration of the first exemplary embodiment, according to a configuration having no partition wall (the prior art), as shown in FIG. 3A, the compressed air having flowed into the buffer chamber 1 substantially equally flows into the air supplying holes 3 and are then injected from the air injecting ports 5. Therefore, the wind speed of the air 7 being injected from the air injecting ports 5 is substantially equal. On the other hand, in the first exemplary embodiment where the first buffer chamber 64 and the second buffer chamber 66 are partitioned by the partition walls 64*a*, 64*b*, as shown in FIG. 3B, portions of the compressed air having flowed into the first buffer chamber 64 and the second buffer chamber 66 flow along the partition walls 64*a*, 66*a* by a coanda effect, and the corresponding compressed air flows into the first air supplying holes 71*a* arranged in the vicinity of the partition walls 64*a*, 64*b*. Thereby, the wind speed of the first air 17*a* being injected from the first air injecting ports 73*a* becomes higher than that of the second air 17*b* being injected from the second air injecting ports 73*b*.

Figure 4:
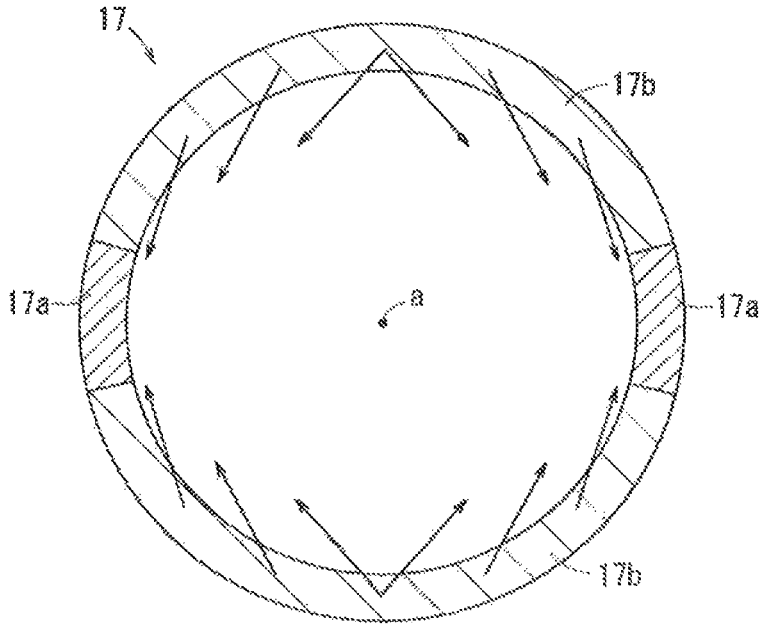
FIG. 4 is a pictorial view illustrating that second air is attracted towards first air.

As a result, as shown in FIG. 4, the areas (first air 17*a*) of relatively high wind speed are formed in portions of the shaping air 17 in the circumferential direction. Since only the air, which is injected from the first air injecting ports 73*a* that are the outlets of the first air supplying holes 71*a* arranged in the vicinity of the partition walls 64*a*, 64*b*, becomes the first air 17*a* of relatively high wind speed, a circumferential range (angle range) within which the first air 17*a* is formed is considerably smaller than a circumferential range within which the second air 17*b* is formed. Also, in the first exemplary embodiment where the two partition walls 64*a*, 64*b* are provided at 180° interval, the first air 17*a* is formed at the locations that are positioned at opposite sides about the axial line "a" (at the locations that are phase-offset by 180°).

Like this, when the flow speed of the portion (first air 17*a*) of the shaping air 17 being annularly injected is made to be higher than the flow speed of the other portion (second air 17*b*), a pressure of the first air 17*a* becomes lower than that of the second air 17*b*. Hence, a portion of the second air 17*b* is attracted towards the first air 17*a*, so that the portion of the second air 17*b* is displaced towards the axial line "a". That is, as shown with arrows in FIG. 4, an originally arc shaped inner side of the second air 17*b* is short cut at the respective portions configuring the second air 17*b* in the circumferential direction, so that the corresponding portion of the second air is displaced towards the first air 17*a* having the relatively low pressure.

As a result, an inner peripheral portion of the second air 17*b* is attracted towards a position that is biased to the axial line "a" than the original formation area of the second air 17*b*. As the inner peripheral portion of the second air 17*b* is attracted towards the axial line "a", it is possible to apply the paint even in the vicinity of the axial line "a". Accordingly, while keeping the substantially circular shape of the coating pattern, it is possible to reduce a non-coated part, which is caused in the vicinity of the axial line of the rotary atomizing head 24, thereby obtaining a coating film having a uniform thickness and effectively performing the coating.

Figure 5A:
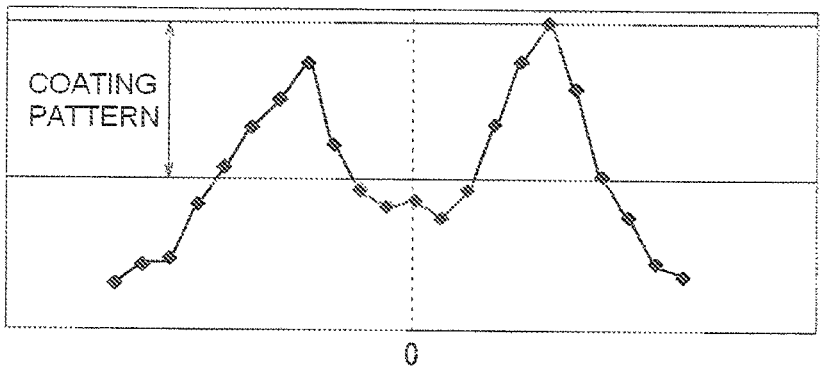
FIG. 5A is a graph showing a change in film thickness along a radial direction of a coating pattern when wind speeds are the same at respective positions of shaping air in a circumferential direction.
Figure 5B:
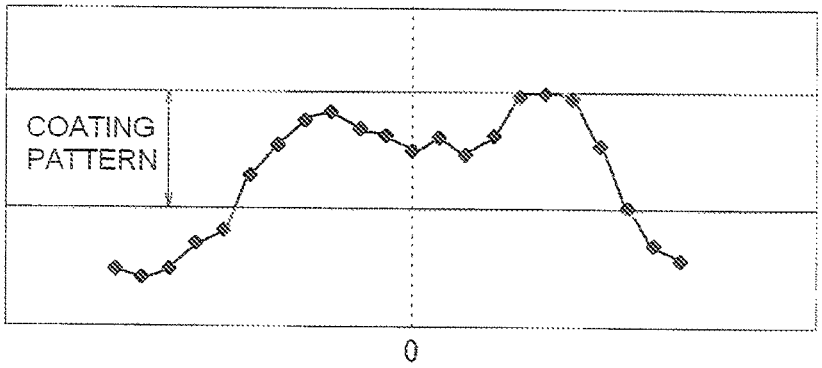
FIG. 5B is a graph showing a change in film thickness along a radial direction of a coating pattern when a high wind speed area is provided at a portion of shaping air in a circumferential direction.

FIGS. 5A and 5B are graphs showing changes in film thickness in a radial direction of a coating pattern when the coating is performed with following coating conditions. FIG. 5A relates to a case where the wind speed of the shaping air is the same irrespective of the circumferential positions, and FIG. 5B relates to a case (first exemplary embodiment) where the high wind speed areas are provided at portions of the shaping air in a circumferential direction. In FIGS. 5A and 5B, a horizontal axis indicates radial positions about the axial line "a" ('0' position) and a vertical axis indicates thickness of a coating film. In the meantime, in any case of FIGS. 5A and 5B, the film thickness data is shown which is obtained when performing the coating for 0.6 second with the position of the coating gun being fixed (stationary).

(Coating Conditions)

revolution (rpm): 35000
paint discharging amount (cc/min): 290
paint discharging time (sec): 0.6
coating distance (mm): 250
applied voltage (kV): −60
air volume (NL/min): 350

As shown in FIG. 5A, when the wind speed of the shaping air is the same irrespective of the circumferential positions, the film thickness is highly increased at positions at a predetermined distance from the position '0' (axial line "a"). Also, in this case, when a half or larger of the maximum film thickness is defined as a coating pattern, in the example of FIG. 5A, the film thickness of the centric portion including the position "0" is smaller than the film thickness of the surrounding coating pattern, and a so-called 'non-coated part' is thus generated in the vicinity of the axial line "a". In the meantime, the "non-coated part" does not mean a part that is not coated at all by the paint but means a part having a film thickness that is considerably smaller than the maximum film thickness.

On the other hand, according to the first exemplary embodiment where the high wind speed areas are provided at parts of the shaping air in a circumferential direction, the relatively larger film thickness at positions at a predetermined distance from the position "0" is smaller, compared to the film thickness at the same positions of FIG. 5A. Also, in this case, when a half or larger of the maximum film thickness is defined as a coating pattern, in the example of FIG. 5B, the centric portion including the position "0" is included in the coating pattern and the 'non-coated part' as described above is not generated.

As described above, according to the coating apparatus 10 and the coating method of the first exemplary embodiment, the second air 17*b* of relatively low wind speed is attached towards the first air 17*a* of relatively high wind speed, so that the second air 17*b* can be displaced towards the axial line "a" of the rotary atomizing head 24. Thereby, while keeping the substantially circular shape of the coating pattern, it is possible to reduce the non-coated part, which is generated in the vicinity of the axial line "a" of the rotary atomizing head 24. Hence, while securing a degree of freedom of the moving of the coating gun 12 when recoating the coating pattern, it is possible to obtain the coating film having a uniform coating thickness without enlarging the member (ring member 27) for injecting the shaping air 17.

Also, according to the first exemplary embodiment, the circumferential portions of the shaping air 17 configure the first air 17*a*, the other circumferential portions configure the second air 17*b* and the first air 17*a* is injected with the smaller range than the circumferential range of the second air 17*b*. Hence, when attracting the second air 17*b* towards the first air 17*a*, it is possible to effectively displace the second air 17*b* towards the axial line "a" of the rotary atomizing head 24.

Also, according to the first exemplary embodiment, the first air 17*a* is formed in the areas that are formed at an equal interval along the circumferential direction. Hence, it is possible to displace the second air 17*b* towards the first air 17*a* with good balance. Thus, it is possible to effectively reduce the non-coated part of the coating pattern and to thus make the coating film thickness further uniform.

In the first exemplary embodiment, the air flows along the partition walls 64*a*, 64*b* by the coanda effect, and the corresponding air flows into the first air supplying holes 71*a* disposed in the vicinity of the partition walls 64*a*, 64*b*, so that the wind speed of the first air 17*a* being injected from the first air injecting ports 73*a* is increased. Also, since the air flow rates to be supplied to the first buffer chamber 64 and the second buffer chamber 66 are preferably the same, it is sufficient to provide one flow rate control system (the electro-pneumatic converter 86, the flow meter 88 and the air control unit 90) and one air supplier 80, so that it is possible to simplify the configuration of the apparatus.

The air injecting ports 68*a*, 70*a* are configured by the plurality of holes, which are provided to the ring member 27 at an interval in the circumferential direction. Instead of this configuration, the air injecting ports may be configured by arc-shaped holes (slits) extending in the circumferential direction.

Figure 6A:
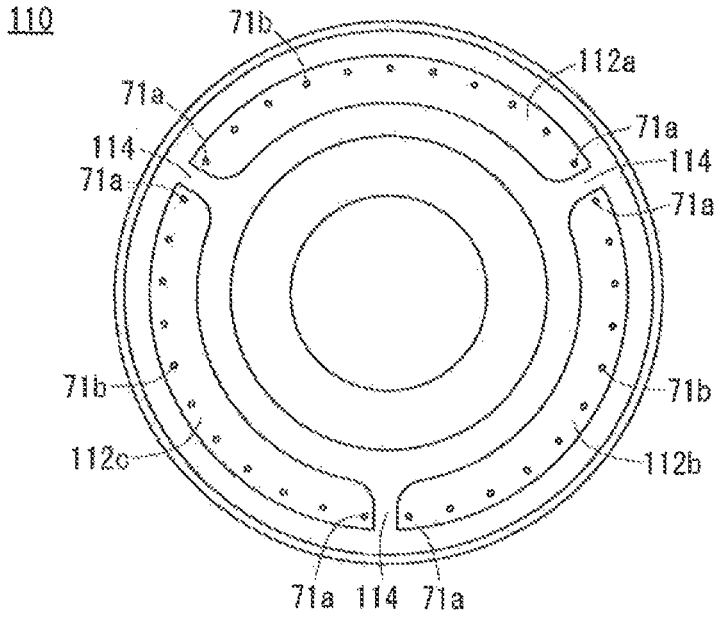
FIG. 6A is a rear view of a ring member according to a first modification of the first exemplary embodiment.
Figure 6B:
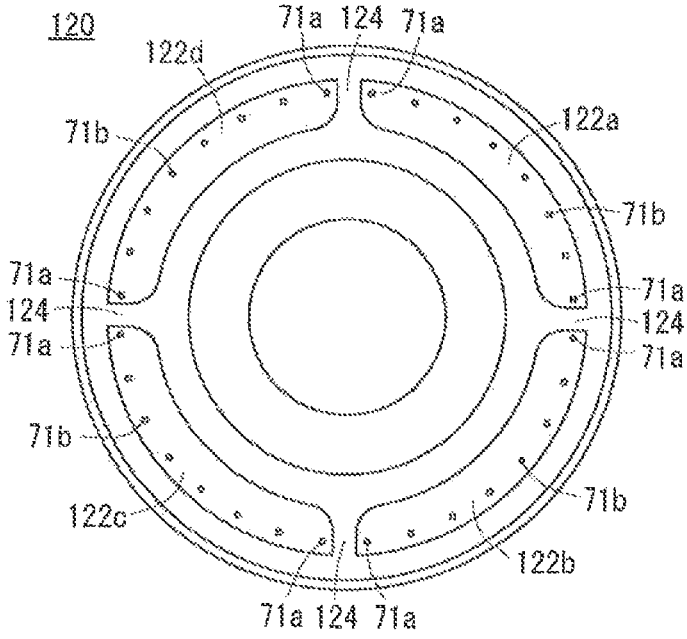
FIG. 6B is a rear view of a ring member according to a second modification of the first exemplary embodiment.

The ring member 27 has the two arc-shaped concave portions (the first arc-shaped concave portion 60 and the second arc-shaped concave portion 62). However, a configuration where three or more arc-shaped concave portions are provided may be also adopted. For example, in the coating apparatus 10, instead of the ring member 27 having the first arc-shaped concave portion 60 and the second arc-shaped concave portion 62, a ring member 110 (refer to FIG. 6A) having three arc-shaped concave portions 112*a* to 112*c* or a ring member 120 (refer to FIG. 6B) having four arc-shaped concave portions 122*a* to 122*d* may be also adopted. In the configurations of FIGS. 6A and 6B, partition walls 114, 124 are preferably disposed at an equal interval in a circumferential direction.

As shown in FIGS. 6A and 6B, even with the configuration where the three or more arc-shaped concave portions are provided, since the wind speed of the air passing through the first air supplying holes 71*a* disposed in the vicinity of the partition walls 114, 124 and then injected to the outside is higher than the wind speed of the air passing through the second air supplying holes 71*b* more distant from the partition walls 114, 124 in the circumferential direction than the first air supplying holes 71*a* and then injected to the outside and the air of relatively low wind speed is attracted towards the air of relatively high wind speed, a portion of the air of relatively low wind speed is displaced towards the axial line "a". Hence, even with the ring members 110, 120, while keeping the substantially circular shape of the coating pattern, it is possible to reduce the non-coated part, which is generated in the vicinity of the axial line "a" of the rotary atomizing head 24 and to thus obtain the coating film having a uniform coating thickness.

Second Exemplary Embodiment

Figure 7:
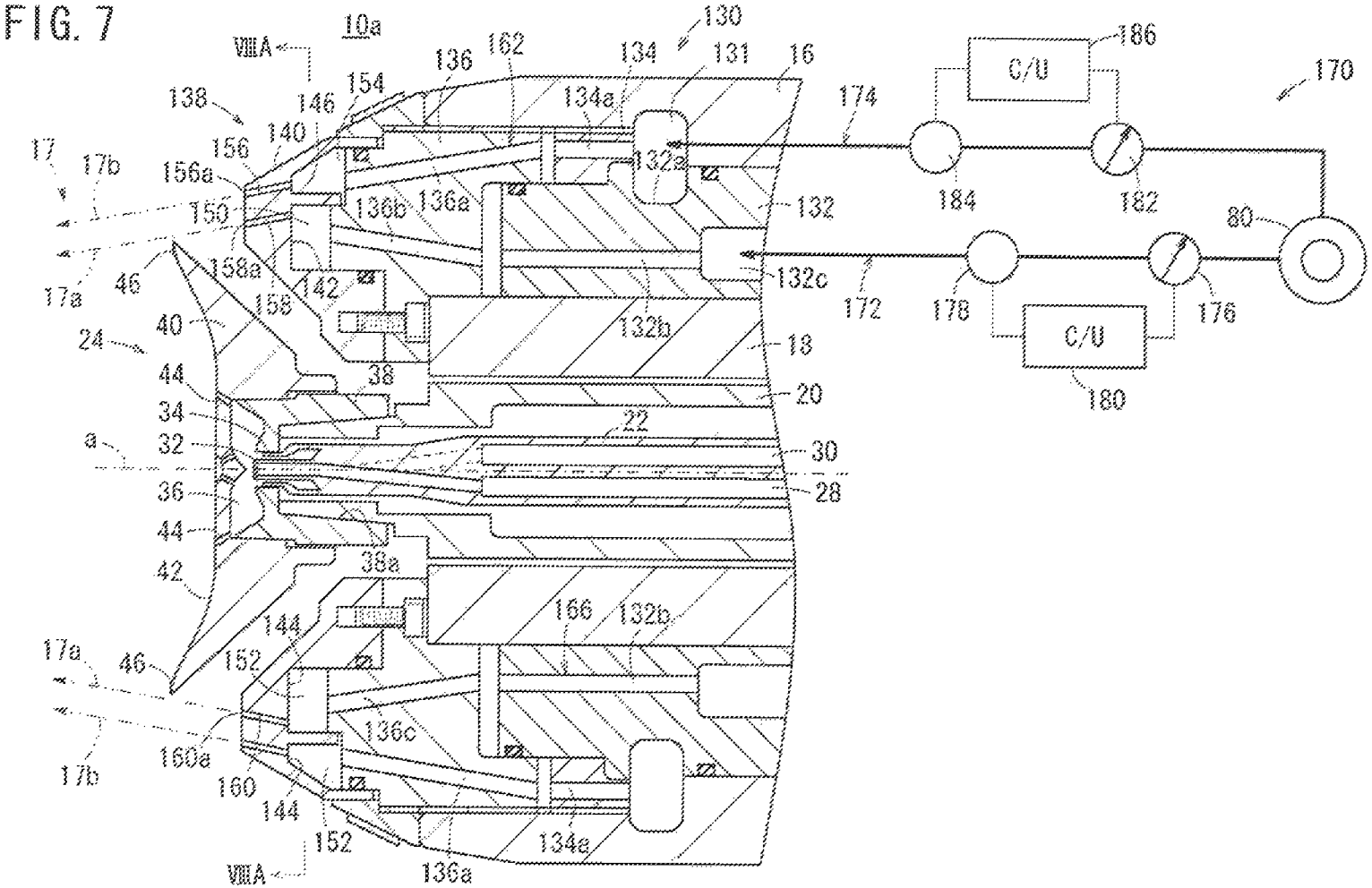
FIG. 7 shows a schematic configuration of a coating apparatus according to a second exemplary embodiment.
Figure 8A:
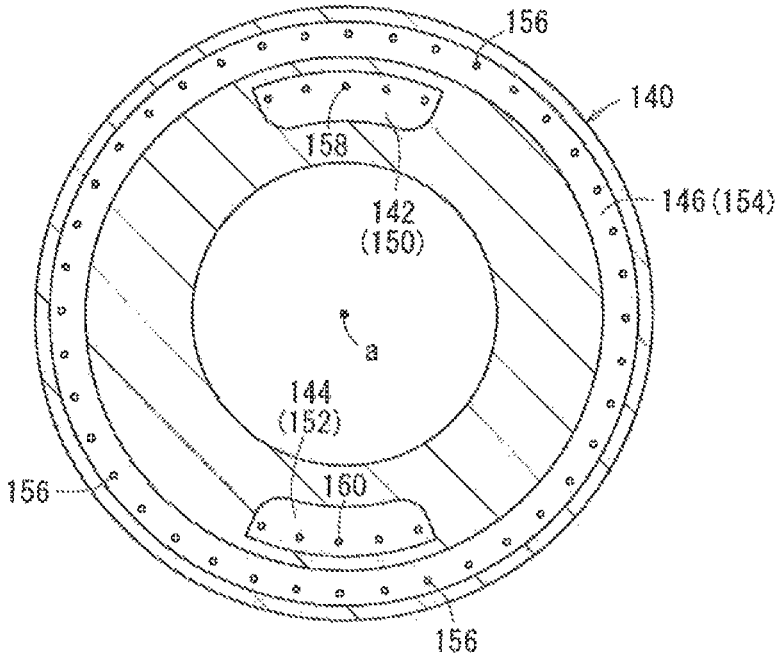
FIG. 8A is a sectional view taken along a line VIIIA-VIIIA of FIG. 7.

FIG. 7 shows a schematic configuration of a coating apparatus 10*a* according to a second exemplary embodiment. FIG. 8A is a cross sectional view taken along a line VIIIA-VIIIA of FIG. 7 (the rotary atomizing head 24 is not shown). Meanwhile, in the coating apparatus 10*a* according to the second exemplary embodiment, the elements exhibiting the same functions and effects as the coating apparatus 10 of the first exemplary embodiment are indicated with the same reference numerals and the detailed descriptions thereof are omitted.

In a coating gun 130 configuring a main body of the coating apparatus 10*a*, a plurality of ring-shaped flow path forming members 132, 134, 136 (three, in the shown example) is disposed between the casing 16 and the air motor 18. Hereinafter, the flow path forming members 132, 134, 136 are referred to as 'first flow path forming member 132', 'second flow path forming member 134' and 'third flow path forming member 136', respectively.

The first flow path forming member 132 is disposed at the outside of the air motor 18 and is formed at an outer peripheral portion thereof with an annular concave portion 132*a*. A plurality of flow paths 132*b* penetrating in an axial line direction is circumferentially formed at an interval and an annular concave portion 132*c* communicating with the flow paths 132*b* is formed at a rear side.

The second flow path forming member 134 is disposed between the first flow path forming member 132 and the casing 16 and is formed with a plurality of flow paths 134*a* penetrating in the axial line "a" direction. An annular space 131 is formed by the first flow path forming member 132, the second flow path forming member 134 and the casing 16.

The third flow path forming member 136 is disposed between the casing 16 and the first flow path forming member 132 and also at the front of the first flow path forming member 132 and the second flow path forming member 134. The third flow path forming member 136 is formed with a plurality of flow paths 136*a*, which communicate with the flow paths 134*a* of the second flow path forming member 134 and are provided at an interval in a circumferential direction, and a plurality of flow paths 136*b*, 136*c*, which communicate with the flow paths 132*b* of the first flow path forming member 132 and are provided at an interval in a circumferential direction thereof A ring member 140 configuring an air injecting unit 138 is fixed to a front end of the third flow path forming member 136 concentrically with the rotary atomizing head 24 so that it surrounds the bell cup 40 at the rear side of the bell cup 40. The ring member injects the shaping air 17 from the rear of an outer peripheral edge portion of the bell cup 40 towards the outer peripheral edge.

As shown in FIG. 8A, the ring member 140 is formed at its backside with a first arc-shaped concave portion 142, a second arc-shaped concave portion 144 and an annular concave portion 146. The first arc-shaped concave portion 142 and the second arc-shaped concave portion 144 are grooves that are formed at the inside of the annular concave portion 146 with regard to a radial direction and extend in a circumferential direction of a circle having the axial line "a" as a center, and have the substantially same volume.

A first arc-shaped buffer chamber 150 is formed by the first arc-shaped concave portion 142 and a front face of the third flow path forming member 136. A second arc-shaped buffer chamber 152 is formed by the second arc-shaped concave portion 144 and the front face of the third flow path forming member 136. A third annular buffer chamber 154 is formed by the annular concave portion 146 and the front face of the third flow path forming member 136.

The ring member 140 is further formed with a plurality of first air supplying holes 158, 160 communicating the first buffer chamber 150, the second buffer chamber 152 and a front face of the ring member 140 and a plurality of second air supplying holes 156 communicating the third buffer chamber 154 and the front face of the ring member 140.

The first air supplying holes 158 are provided at an equal interval in the circumferential direction about the axial line "a". The first air supplying hole is opened at its one end (rear end) in the first buffer chamber 150 and is opened at its other end (front end) as a first air injecting port 158*a* in the front face. The second air supplying holes 160 are provided at an equal interval in the circumferential direction about the axial line "a". The second air supplying hole is opened at its one end (rear end) in the second buffer chamber 152 and is opened at its other end (front end) as the other first air injecting port 160*a* in the front face.

The second air supplying holes 156 are provided at an equal interval in the circumferential direction about the axial line "a". The second air supplying hole is opened at its one end (rear end) in the third buffer chamber 154 and is opened at its other end (front end) as a second air injecting port 156*a* in the front face.

The first air supplying holes 158, 160 are circumferentially provided at an equal interval on the same periphery at the inside of the second air supplying holes 156, are a little inclined to be close to the axial line "a" of the rotary atomizing head 24 towards the front and are opened towards the outer peripheral edge portion of the bell cup 40. The second air supplying holes 156 are circumferentially provided at an equal interval and are a little inclined to be close to the axial line "a" of the rotary atomizing head 24 towards the front.

Also, the first air supplying holes 158, 160 and the second air supplying holes 156 are inclined relative to the axial line "a" by a predetermined angle (for example, 30 to 50 degrees) in the circumferential direction.

In the coating gun 130 shown in FIG. 7, a first air supplying channel 166 for supplying compressed air to the first buffer chamber 150 and the second buffer chamber 152 is configured by the annular concave portion 132*c* and the flow path 132*b* of the first flow path forming member 132 and the flow paths 136*b*, 136*c* of the third flow path forming member 136. A second air supply channel 162 for supplying compressed air to the third buffer chamber 154 is configured by the space 131, the flow path 134*a* of the second flow path forming member 134 and the flow path 136*a* of the third flow path forming member 136.

An air supplying system 170 has the air supplier 80, a first air line 172 that guides the compressed air from the air supplier 80 to the first air supplying channel 166 and a second air line 174 that guides the compressed air from the air supplier 80 to the second air supplying channel 162. The air supplier 80 is the same as the air supplier 80 shown in FIG. 1.

The first air line 172 is provided thereon with a flow meter 176 and an electro-pneumatic converter 178. An air control unit 180 controls the electro-pneumatic converter 178 so that a flow rate of the air to be supplied to the first air supplying channel 166 becomes a predetermined flow rate, by using a flow rate value detected in the flow meter 176 as a feedback value.

The second air line 174 is provided thereon with a flow meter 182 and an electro-pneumatic converter 184. An air control unit 186 controls the electro-pneumatic converter 184 so that a flow rate of the air to be supplied to the second air supplying channel 162 becomes a predetermined flow rate, by using a flow rate value detected in the flow meter 182 as a feedback value.

The compressed air that is supplied to the coating gun 130 by the first air line 172 passes through the first air supplying channel 166 and is then injected from the first air injecting ports 158*a*, 160*a*, as first air 17*a*. The compressed air that is supplied to the coating gun 130 by the second air line 174 passes through the second air supplying channel 162 and is then injected from the second air injecting ports 156*a*, as second air 17*b*.

In the coating apparatus 10*a*, the first air 17*a* that is injected from the first air injecting ports 158*a*, 160*a* configures predetermined portions of the shaping air 17 and has a relatively high wind speed. The second air 17*b* that is injected from the second air injecting ports 156*a* configures other portions of the shaping air 17 and has a relatively low wind speed. That is, the wind speed (flow speed) of the first air 17*a* is higher than the wind speed (flow speed) of the second air 17*b*.

Since the total number of the first air supplying holes 158, 160 is smaller than that of the second air supplying holes 156, a total sum of flow path sectional areas of the first air supplying holes 158, 160 is smaller than that of the second air supplying holes 156. Therefore, even when a flow rate of the compressed air to be supplied to the first air line 172 is set to be same as that of the compressed air to be supplied to the second air line 174, the wind speed of the first air 17*a* is higher than the wind speed of the second air 17*b*. In the meantime, the flow rate of the compressed air to be supplied to the first air line 172 and the flow rate of the compressed air to be supplied to the second air line 174 may be set different so that a flow speed ratio of the first air 17*a* and the second air 17*b* becomes a desired value.

As described below, in the coating apparatus 10*a*, a portion of the second air 17*b* is attracted by the first air 17*a*, so that it is possible to reduce a non-coated part, which is caused in the vicinity of the rotational axis "a" of the rotary atomizing head 24, while keeping the substantially circular shape of the coating pattern. Therefore, it is preferable that a circumferential range within which the first air 17*a* is formed is set to be considerably smaller than a circumferential range within which the second air 17*b* is formed. Hence, the circumferential range (angle range) within which the first air 17*a* is formed may be about 5 to 45 degrees.

During painting by the coating apparatus 10*a* configured as described above, the rotational shaft 20 is rotated at high speed by the air motor 18. And, paint is discharged towards the paint storage 36 of the rotary atomizing head 24 from the paint supplying nozzle 32. Thereby, the paint is thinned on the paint discharging face 42 and, thereafter, subdivided in the grooves 46 to be discharged as liquid threads from the outer peripheral end of the bell cup 40 and to be atomized as paint particles. At this time, since the shaping air 17 is injected from the first air injecting ports 158*a*, 160*a* and the second air injecting ports 156*a* towards the outer peripheral edge portion of the bell cup 40, the atomization of the paint is promoted by the shaping air 17. The electrified paint particles having been atomized fly towards the work to coat the work. The sprayed pattern of the paint at this time is pattern-molded by the shaping air 17 (first air 17*a* and second air 17*b*).

Figure 8B:
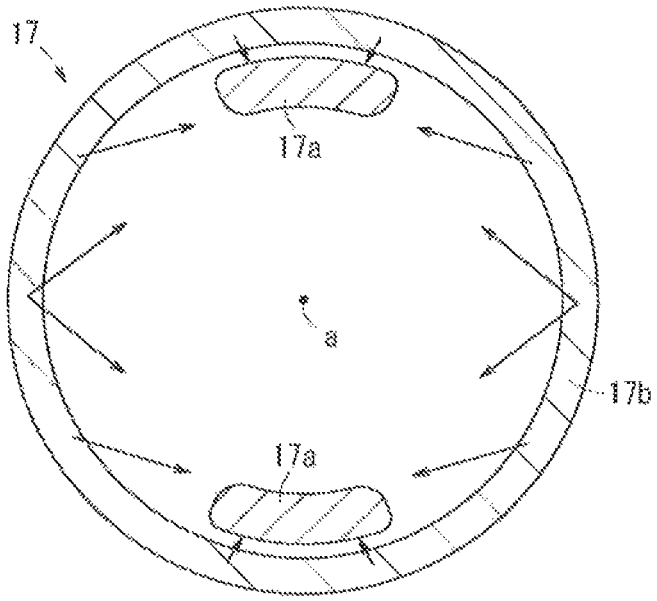
FIG. 8B is a pictorial view illustrating that second air is attracted towards first air.

In this case, in the coating apparatus 100*a* of the second exemplary embodiment, the first air 17*a* is formed only in a part of the circumferential range of the second air 17*b* at the inside of the annular second air 17*b* and the wind speed of the first air 17*a* is made to be higher than that of the second air 17*b*. Thus, the pressure of the first air 17*a* is lowered below that of the second air 17*b*, so that a portion of the second air 17*b* is attracted towards the first air 17*a*. As a result, the portion of the second air 17*b* is displaced towards the axial line. That is, as shown with the arrows in FIG. 8B, an original ring shaped inner side of the second air 17*b* is short cut at the respective portions configuring the second air 17*b* in the circumferential direction, so that an action of displacing the second air towards the first air 17*a* having the relatively low pressure is generated.

As a result, an inner peripheral portion of the second air 17*b* is attracted towards a position that is biased to the axial line "a" than the original formation area of the second air 17*b*. As the inner peripheral portion of the second air 17*b* is attracted towards the axial line "a", it is possible to apply the paint even in the vicinity of the axial line "a". Accordingly, while keeping the substantially circular shape of the coating pattern, it is possible to reduce a non-coated part, which is caused in the vicinity of the axial line "a" of the rotary atomizing head 24, thereby obtaining a coating film having a uniform thickness and effectively performing the coating.

In the shown example, the first air injecting ports 158*a*, 160*a* are configured by the plurality of holes, which are provided to the ring member 140 at an interval in the circumferential direction. Instead of this configuration, the first air injecting ports may be configured by arc-shaped holes (slits) extending in the circumferential direction. In the shown example, the second air injecting ports 156*a* are configured by the plurality of holes, which are provided to the ring member 140 at an interval in the circumferential direction. Instead of this configuration, the second air injecting ports may be configured by arc-shaped holes (slits) extending in the circumferential direction.

The ring member 140 has the two arc-shaped concave portions (the first arc-shaped concave portion 142 and the second arc-shaped concave portion 144). However, a configuration where three or more arc-shaped concave portions are provided may be also adopted. Alternatively, the first air 17*a* may be formed at an equal interval in the circumferential direction at the inside of the second air 17*b*.

Needless to say, in the second exemplary embodiment, regarding the respective constitutional parts common to the first exemplary embodiment, it is possible to obtain the same or equivalent operations and effects as or to those by the common constitutional parts of the first exemplary embodiment.

Third Exemplary Embodiment

Figure 9:
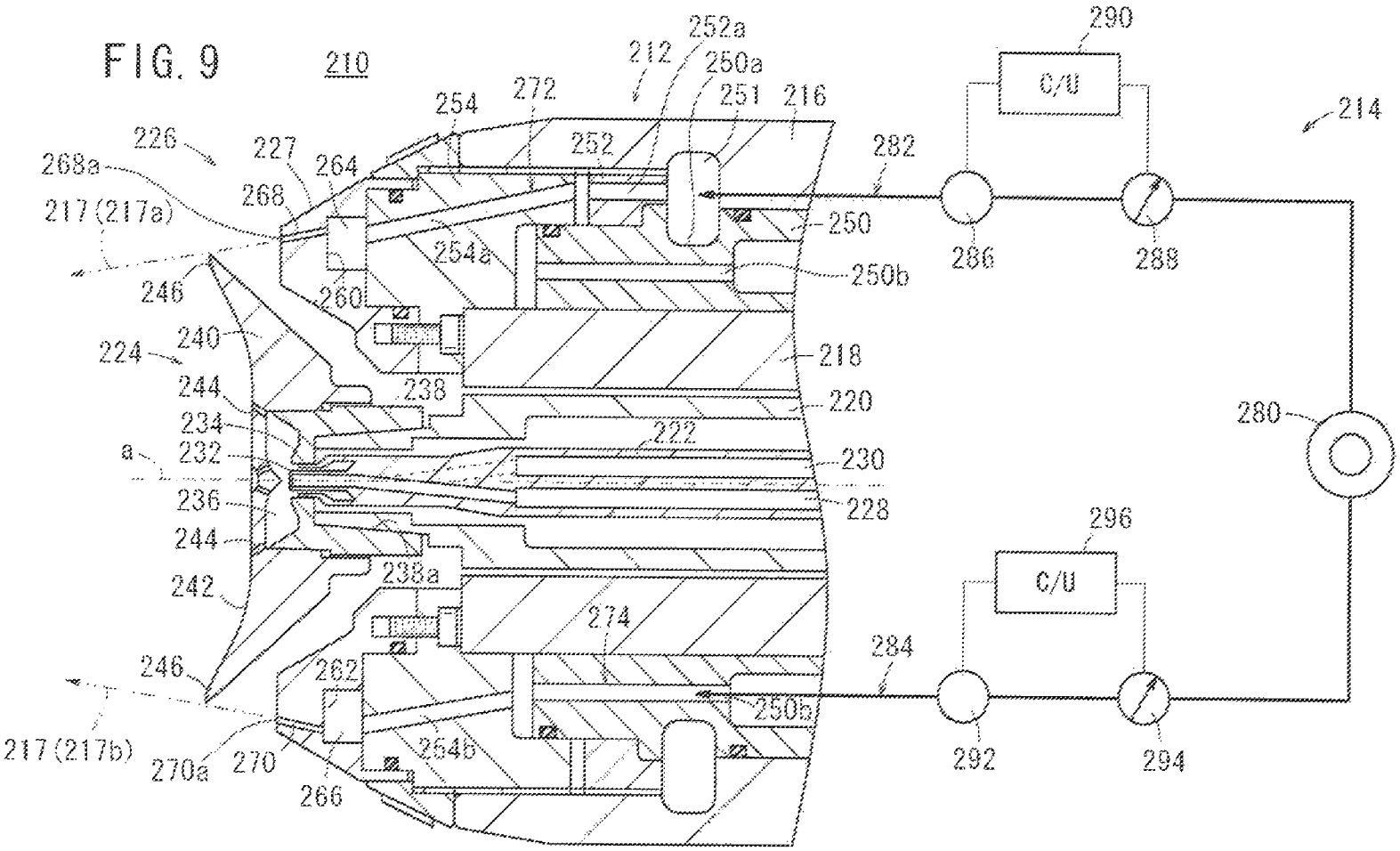
FIG. 9 shows a schematic configuration of a coating apparatus according to a third exemplary embodiment.

FIG. 9 shows a schematic configuration of a coating apparatus 210 according to a third exemplary embodiment. As shown in FIG. 9, the coating apparatus 210 has at least a coating gun 212 that configures a main body of the apparatus, and an air supplying system 214 that supplies air for shaping air 217 to the coating gun 212.

The coating gun 212 has a casing 216 (housing), an air motor 218 installed in the casing 216, a hollow rotational shaft 220 rotating at high speed by the air motor 218, a conduit 222 insertion-penetrating into a hollow portion of the rotational shaft 220, a bell shaped rotary atomizing head 224 installed at a front end of the rotational shaft 220, and an air injecting unit 226 that injects the shaping air 217 towards an outer peripheral edge of a front end of the rotary atomizing head 224.

The air motor 218 is supplied with compressed air from a compressed air supplier (not shown) to thereby rotate the rotational shaft 220 at high speed. The rotational shaft 220 is connected to a high voltage generator (not shown) for generating a high voltage. Accordingly, the rotary atomizing head 224 is applied with a highly negative voltage through the rotational shaft 220. Also, the rotational shaft 220 is a hollow cylindrical member and the conduit 222 is disposed in the hollow portion thereof.

The conduit 222 is formed therein with a paint supplying channel 228 for supplying paint and a cleaning solution supplying channel 230 for supplying a cleaning solution. A front end portion of the conduit 222 is formed in a dual pipe shape, and a paint supplying nozzle 232 for discharging paint and a cleaning solution supplying nozzle 234 for discharging a cleaning solution are concentrically formed.

The rotary atomizing head 224 is fixed to the front end of the rotational shaft 220. When the rotational shaft 220 rotates during the operation of the air motor 218, the rotary atomizing head 224 also rotates integrally together with the rotational shaft 220. The rotary atomizing head 224 is formed therein with a paint storage 236 for temporarily storing paint supplied through the conduit 222. The paint storage 236 is a circle shaped space. The paint supplying nozzle 232 directs towards a centric portion of the paint storage 236.

The rotary atomizing head 224 is formed of an inner member 238 fixed to the rotational shaft 220 and a bell cup 240 fixed to an outer peripheral portion of the inner member 238. The paint storage 236 is formed between the inner member 238 and the bell cup 240. The inner member 238 is formed therein with a concave portion 238*a* into which a front end portion of the rotational shaft 220 is fitted. The inner member 238 is formed at a front centric portion thereof with an opening into which a front end portion of the conduit 222 insertion-penetrates.

The bell cup 240 has a circular cup shape that is enlarged outwards in a radial direction and towards its front direction. The bell cup 240 is formed at a front face thereof with a paint discharging face 242 thinning the paint supplied to the front face. The paint discharging face 242 is inclined in a front direction and outwards in a radial direction, is doughnut-shaped when viewed from its front side, and serves to thin paint from the paint storage 236 due to the centrifugal force resulting from the rotation of the bell cup 240.

The bell cup 240 is provided with a plurality of paint supplying holes 244 for supplying paint to the paint discharging face 242, which are formed at an equal interval along the circumferential direction. Each of the paint supplying holes 44 is inclined in far direction from the axial line "a" of the rotary atomizing head 224 towards the front of the rotary atomizing head 224, and is opened at its one end (inner side end) in the paint storage 236 and opened at its other end (outer side end) in the front face of the bell cup 240.

A rear centric portion of the bell cup 240 is configured to protrude towards an inner side (the conduit 222 side) of the paint storage 236 and to distribute the supplied paint or cleaning solution to the outer side thereof in a radial direction.

A plurality of grooves 246 for injecting paint as liquid threads is arranged at an equal interval in a circumferential direction on a front side outer peripheral edge portion of the bell cup 240 (i.e., the outer peripheral edge portion of the paint discharging face 242). The respective grooves 246 are provided at an equal interval throughout the outer peripheral edge portion of the paint discharging face 242 and extended along the radial direction of the rotary atomizing head 224, and serve to subdivide a thin film shaped paint flowing towards the outer side thereof in a radial direction along the paint discharging face 242. Thereby, thin thread shaped paint (liquid thread) is discharged from the outer peripheral end of the bell cup 240.

A plurality of ring-shaped flow path forming members 250, 252, 254 (three, in the shown example) is disposed between the casing 216 and the air motor 218. Hereinafter, the flow path forming members 250, 252, 254 are referred to as 'first flow path forming member 250', 'second flow path forming member 252' and 'third flow path forming member 254', respectively. The first flow path forming member 250 is disposed at the outside of the air motor 218, is formed at an outer peripheral portion thereof with an annular concave portion 250*a* and is also formed with a plurality of flow paths 250*b* penetrating in the axial line direction, which are formed at an interval in the circumferential direction.

The second flow path forming member 252 is disposed between the first flow path forming member 250 and the casing 216 and is formed with a flow path 252*a* penetrating in an axial line direction. An annular space 251 is formed by the first flow path forming member 250, the second flow path forming member 252 and the casing 216. The third flow path forming member 254 is disposed between the casing 216 and the first flow path forming member 250 and also at the front of the first flow path forming member 250 and the second flow path forming member 252. The third flow path forming member 254 is formed with a flow path 254*a* communicating with the flow path 252*a* of the second flow path forming member 252 and a flow path 254*b* communicating with the flow path 250*b* of the first flow path forming member 250.

A ring member 227 configuring the air injecting unit 226 is fixed to a front end of the third flow path forming member 254 concentrically with the bell cup 240 so that it surrounds the bell cup 240 at the rear side of the bell cup 240. The ring member injects the shaping air 217 from the rear of an outer peripheral edge portion of the bell cup 240 towards the outer peripheral edge portion.

Figure 10:
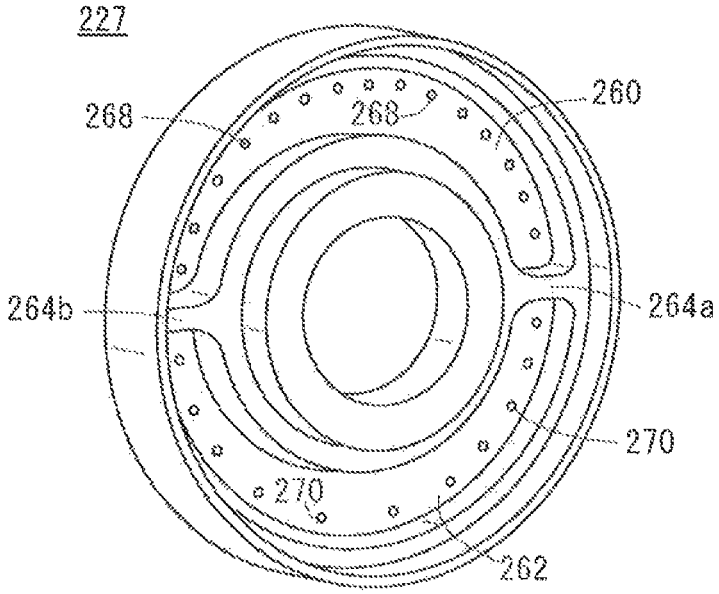
FIG. 10 is a perspective view showing a backside of a ring member of the coating apparatus shown in FIG. 9.

FIG. 10 is a perspective view of the ring member 227, when seen from a backside thereof. As shown in FIGS. 9 and 10, the ring member 227 is formed at its backside with a first arc-shaped concave portion 260 and a second arc-shaped concave portion 262. The first arc-shaped concave portion 260 and the second arc-shaped concave portion 262 are partitioned by partition walls 264*a*, 264*b* and have the substantially same volume. A first arc-shaped buffer chamber 264 is formed by the first arc-shaped concave portion 260 and a front face of the third flow path forming member 254. A second arc-shaped buffer chamber 266 is formed by the second arc-shaped concave portion 262 and thr front face of the third flow path forming member 254.

The ring member 227 is further formed with a plurality of first air supplying holes 268 communicating the first buffer chamber 264 with a front face of the ring member 227 and a plurality of second air supplying holes 270 communicating the second buffer chamber 266 with the front face of the ring member 227. The first air supplying hole 268 is opened at its one end (rear end) in the first buffer chamber 264 and is opened at its other end (front end) as a first air injecting port 68*a* in the front face. The second air supplying hole 270 is opened at its one end (rear end) in the second buffer chamber 266 and is opened at its other end (front end) as a second air injecting port 270*a* in the front face.

The first air supplying holes 268 and the second air supplying holes 270 are respectively provided at an equal interval in a circumferential direction about the axial line "a", are inclined to be close to the axial line "a" of the rotary atomizing head 224 towards the front and are opened towards the outer peripheral edge portion of the bell cup 240. Also, the first air supplying holes 268 and the second air supplying holes 270 are inclined relative to the axial line "a" by a predetermined angle (for example, 30 to 50 degrees) in the circumferential direction.

In the coating gun 212 shown in FIG. 9, a first air supplying channel 272 is configured by the annular space 251, the flow path 252*a* of the second flow path forming member 252, the flow path 254*a* of the third flow path forming member 254, the first buffer chamber 264 and the first air supplying holes 268. Also, a second air supplying channel 274 is configured by the flow path 250*b* of the first flow path forming member 250, the flow path 254*b* of the third flow path forming member 254, the second buffer chamber 266 and the second air supplying holes 270.

As shown in FIG. 9, the air supplying system 214 has an air supplier 280 and a first air line 282 and a second air line 284 guiding the compressed air from the air supplier 280 to the coating gun 212. The air supplier 280 is an air pump, for example, and delivers the compressed air. The first air line 282 supplies the compressed air to the annular space 251.

The first air line 282 is provided thereon with a first flow meter 282 and a first electro-pneumatic converter 286. A first air control unit 290 controls the first electro-pneumatic converter 286 so that a flow rate of the air to be supplied to the first air supplying channel 272 becomes a predetermined flow rate (hereinafter, referred to as 'first flow rate'), by using a flow rate value detected in the first flow meter 288 as a feedback value.

The second air line 284 is provided thereon with a second flow meter 284 and a second electro-pneumatic converter 292. A second air control unit 296 controls the second electro-pneumatic converter 292 so that a flow rate of the air to be supplied to the second air supplying channel 274 becomes a predetermined flow rate (hereinafter, referred to as 'second flow rate'), by using a flow rate value detected in the second flow meter 294 as a feedback value.

The compressed air that is supplied to the coating gun 212 by the first air line 282 of the air supplying system 214 sequentially passes through the annular space 251, the flow paths 252*a*, the first buffer chamber 264 and the first air supplying holes 268 and is then injected from the air injecting ports 268*a*, as first air 217*a*. Also, the compressed air that is supplied to the coating gun 212 by the second air line 284 of the air supplying system 214 sequentially passes through the flow paths 250*b*, the flow path 254*b*, the second buffer chamber 266 and the second air supplying holes 270 and is then injected from the second air injecting ports 270*a*, as second air 217*b*.

In the coating apparatus 210, the first air 217*a* that is injected from the first air injecting ports 268*a* configures predetermined areas of the shaping air 217 in a circumferential direction and has relatively high wind speed. The second air 217*b* that is injected from the second air injecting ports 270*a* configures predetermined other areas of the shaping air 217 in a circumferential direction and has relatively low wind speed. That is, the wind speed (flow speed) of the first air 217*a* is higher than the wind speed (flow speed) of the second air 217*b*. Hence, the first flow rate that is controlled by the first electro-pneumatic converter 286 is set to be larger than the second flow rate that is controlled by the second electro-pneumatic converter 292.

The coating apparatus 210 of the third exemplary embodiment is configured as described above. In the below, the operations and effects thereof are described.

During painting, the rotational shaft 220 is rotated at high speed by the air motor 218. And, paint is discharged towards the paint storage 236 of the rotary atomizing head 224 from the paint supplying nozzle 232. Thereby, the paint having flowed into the paint storage 236 flows into the paint supplying holes 244. In this case, the paint passing through the paint supplying holes 244 is discharged onto the paint discharging face 242 and thinned thereon, and thereafter, subdivided in the grooves 246 to be discharged as liquid threads from the outer peripheral end of the bell cup 240. The liquid threads discharged from the outer peripheral end of the bell cup 240 are atomized as paint particles.

At this time, since a high voltage is applied between the rotary atomizing head 224 and a work (object to be painted), the electrified paint particles having been atomized by the rotary atomizing head 224 fly towards the work to coat the work. The sprayed pattern of the paint at this time is pattern-molded by the shaping air 217 (first air 217*a* and second air 217*b*) being injected from the first air injecting ports 268*a* and the second air injecting ports 270*a*.

Figure 11A:
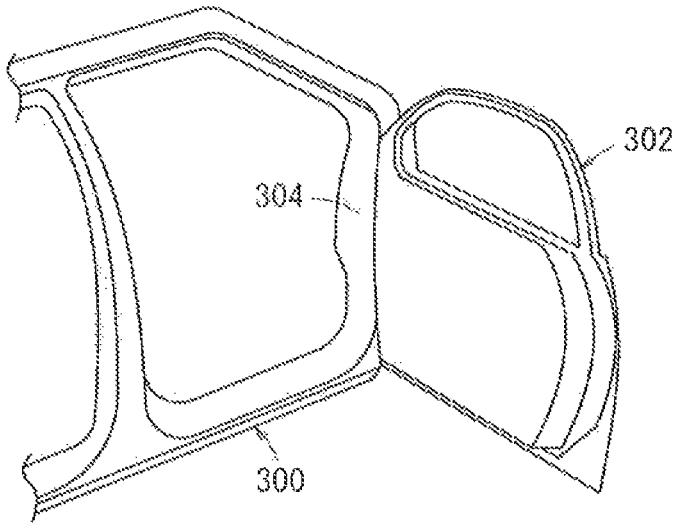
FIG. 11A is a perspective view showing a body and a door of a vehicle.
Figure 11B:
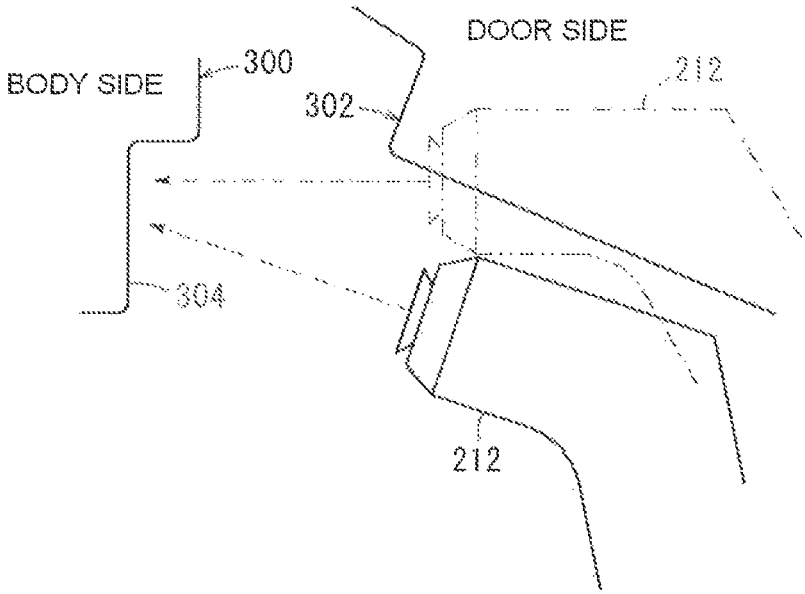
FIG. 11B is a pictorial view showing a relation between an arrangement position of a coating gun of the coating apparatus and an angle of the coating gun relative to a part to be painted.

In the meantime, as shown in FIG. 11A, a case is assumed in which the coating is performed for a door inner plate 304 adjacent to a connection part of a body 300 and a door 302 of an automobile. In this case, as shown in FIG. 11B, even though it is intended to perpendicularly arrange the coating gun 212 to a part to be painted for the efficient printing, since the coating gun 212 interferes with the door 302, it is not possible to dispose the coating gun 212 like that. Therefore, as shown with the solid line in FIG. 11B, the coating may be performed with the coating gun 212 being obliquely arranged.

Figure 12:
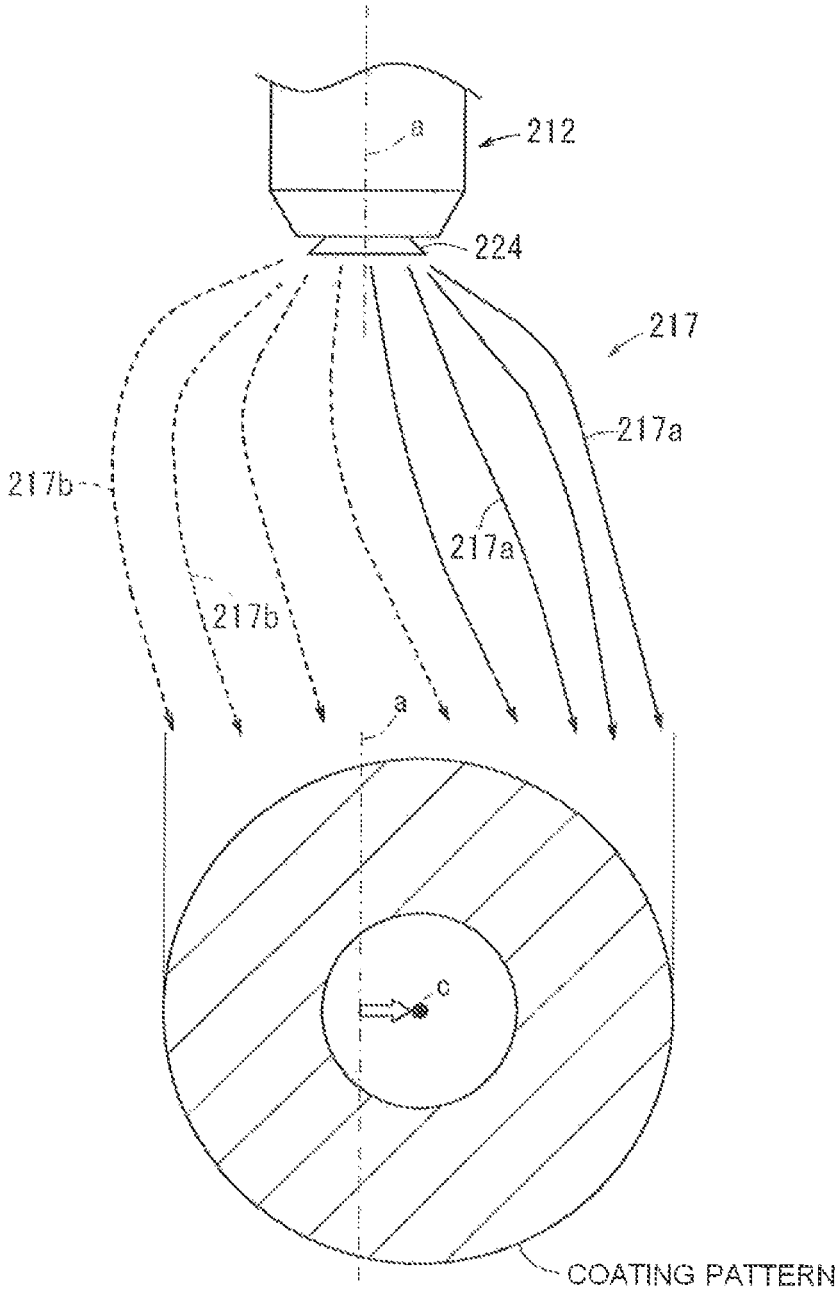
FIG. 12 is a pictorial view showing a coating pattern of paint discharged from the coating gun.

In this case, according to the coating apparatus 210 of the third exemplary embodiment, the first air 217*a* of relatively high wind speed is injected from the first air injecting ports 268*a* and the second air 217*b* of relatively low wind speed is injected from the second air injecting ports 270*a*. Like this, when the flow speed of the portion (first air 217*a*) of the shaping air 217 being annularly injected is made to be higher than the other portion (second air 217*b*), since the pressure of the first air 217*a* is lowered below the pressure of the second air 217*b*, the second air 217*b* is attracted towards the first air 217*a*, as shown in FIG. 12. As a result, it is possible to form a coating pattern having a center "c" that is a position deviated from the axial line "a" of the rotary atomizing head 224. Accordingly, even when the coating is performed with the axial line "a" of the rotary atomizing head 224 being inclined to the part to be coated, not being perpendicular thereto, it is possible to perform the coating by using a part of the coating pattern having a larger amount of coating, thereby effectively performing the coating.

A table 1 is a test result showing how the coating pattern is formed when a wind speed ratio of the first air 217*a* and the second air 217*b* is changed with below coating conditions. In the table 1, a 'first air wind speed' and a 'second air wind speed' are the wind speeds of the first air 217*a* and the second air 217*b* on the outer peripheral edge portion of the bell cup 240. The 'wind speed ratio' is a ratio of the wind speed of the first air 217*a* to the wind speed of the second air 217*b*, which is expressed by a percentage. An 'amount of deviation from a center' is an amount of deviation of the center "c" of the coating pattern from the axial line "a" of the rotary atomizing head 224.

(Coating Conditions)

revolution (rpm): 35000
discharging amount (cc/min): 290
discharging time (sec): 0.6
coating distance (mm): 250
applied voltage (kV): −60

TABLE 1

| first flow rate (NL)/ second flow rate (NL) | first air wind speed (m/sec) | second air wind speed (m/sec) | wind speed ratio | amount of deviation from center | divided line |
|---|---|---|---|---|---|
| 350/350 | 125 | 125 | 100% | 0 | no |
| 350/300 | 125 | 104 | 120% | 19 | no |
| 350/250 | 125 | 91 | 137% | 39 | no |
| 250/200 | 125 | 70 | 179% | 80 | generated |

From the table 1, it can be seen that the higher the wind speed of the first air 217*a* relative to the second air 217*b* is, the amount of deviation of the center of the coating pattern is increased. In the meantime, when the wind speed ratio is increased too much, it was found that a divided line (a part to which the paint is not coated) is generated in a part of the coating pattern. In the result shown in the table 1, when the wind speed ratio is 137%, a divided line is not generated and when the wind speed ratio is 179%, a divided line is generated. Hence, it is preferably to set the wind speed of the first air 217*a* to be 140% or lower of the wind speed of the second air 217*b*. By setting the wind speeds like that, it is possible to perform the uniform coating without splitting the coating pattern.

The first air injecting ports 268*a* are configured by the plurality of holes, which are provided to the ring member 227 at an interval in the circumferential direction. Instead of this configuration, the first air injecting ports may be configured by arc-shaped holes (slits) extending in the circumferential direction. Likewise, the second air injecting ports 270*a* are configured by the plurality of holes, which are provided to the ring member 227 at an interval in the circumferential direction. Instead of this configuration, the second air injecting ports may be configured by arc-shaped holes (slits) extending in the circumferential direction.

The ring member 227 has the two arc-shaped concave portions (the first arc-shaped concave portion 260 and the second arc-shaped concave portion 262). However, a configuration where three or more arc-shaped concave portions are provided may be also adopted. For example, in the coating apparatus 210, instead of the ring member 227 having the first arc-shaped concave portion 260 and the second arc-shaped concave portion 262, a ring member 310 (refer to FIG. 13A) having four arc-shaped concave portions 312*a* to 312*d* or a ring member 320 (refer to FIG. 13B) having eight arc-shaped concave portions 322*a* to 322*h* may be also adopted.

Figure 13A:
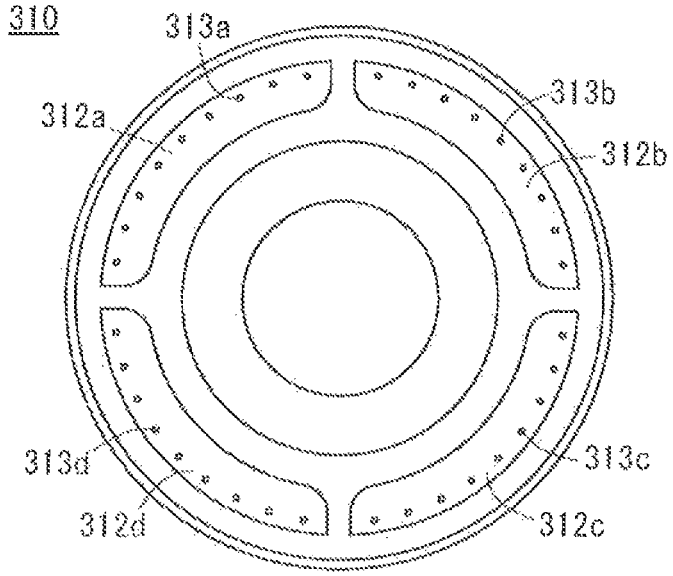
FIG. 13A is a rear view of a ring member according to a first modification of the third exemplary embodiment.

When the ring member 310 shown in FIG. 13A is adopted, the first air 217*a* (refer to FIG. 9) of relatively high wind speed is injected from a plurality of air supplying holes 313*a* provided in the arc-shaped concave portion 312*a* and the second air 217*b* (refer to FIG. 9) of relatively low wind speed is injected from a plurality of air supplying holes 313*b* to 313*d* provided in the other arc-shaped concave portions 312*b* to 312*d*. Thereby, it is possible to control a deviation direction of the center "c" of the coating pattern more precisely.

In the meantime, the first air 217*a* may be injected from the air supplying holes 313*a*, 313*b* provided in two of the four arc-shaped concave portions 312*a* to 312*d*, for example, in the arc-shaped concave portions 312*a*, 312*b* and the second air 217*b* may be injected from the air supplying holes 313*c*, 313*d* provided in the other arc-shaped concave portions 312*c*, 312*d*. In this case, the same coating pattern as the case where the ring member 227 shown in FIGS. 9 and 10 is adopted is formed.

Figure 13B:
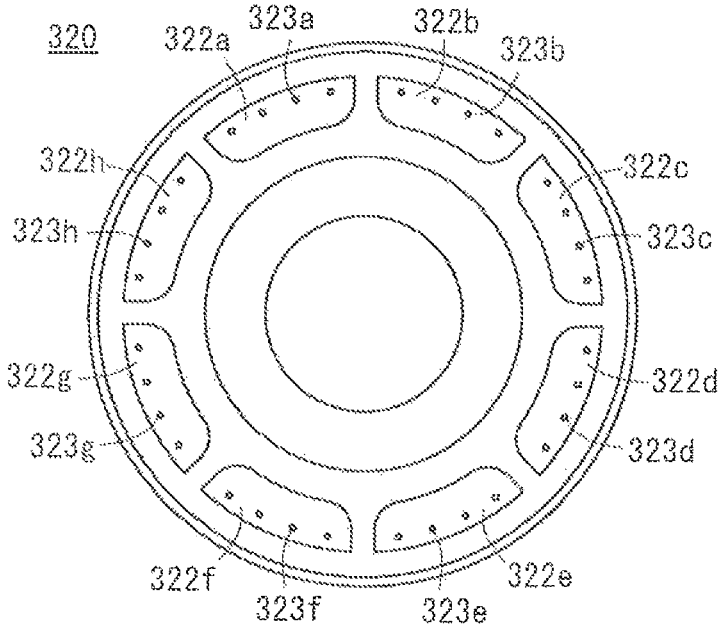
FIG. 13B is a rear view of a ring member according to a second modification of the third exemplary embodiment.

When the ring member 320 shown in FIG. 13B is adopted, the first air 217*a* of relatively high wind speed is injected from a plurality of air supplying holes 323*a* provided in the arc-shaped concave portion 322*a* and the second air 217*b* of relatively low wind speed is injected from a plurality of air supplying holes 323*b* to 323*h* provided in the other arc-shaped concave portions 322*b* to 322*h*. Thereby, it is possible to control a deviation direction of the center "c" of the coating pattern more precisely.

In the meantime, the first air 217*a* may be injected from the air supplying holes 323*a* to 323*c* provided in two to four of the eight arc-shaped concave portions 322*a* to 322*h*, for example, in the arc-shaped concave portions 322*a* to 322*c* and the second air 217*b* may be injected from the air supplying holes 323*d* to 323*h* provided in the other arc-shaped concave portions 322*d* to 322*h*. When the first air 217*a* is injected from the air supplying holes 323*a* to 323*d* of the arc-shaped concave portions 322*a* to 322*d*, the same coating pattern as the case where the ring member 227 shown in FIGS. 9 and 10 is adopted is formed.

Fourth Exemplary Embodiment

Figure 14:
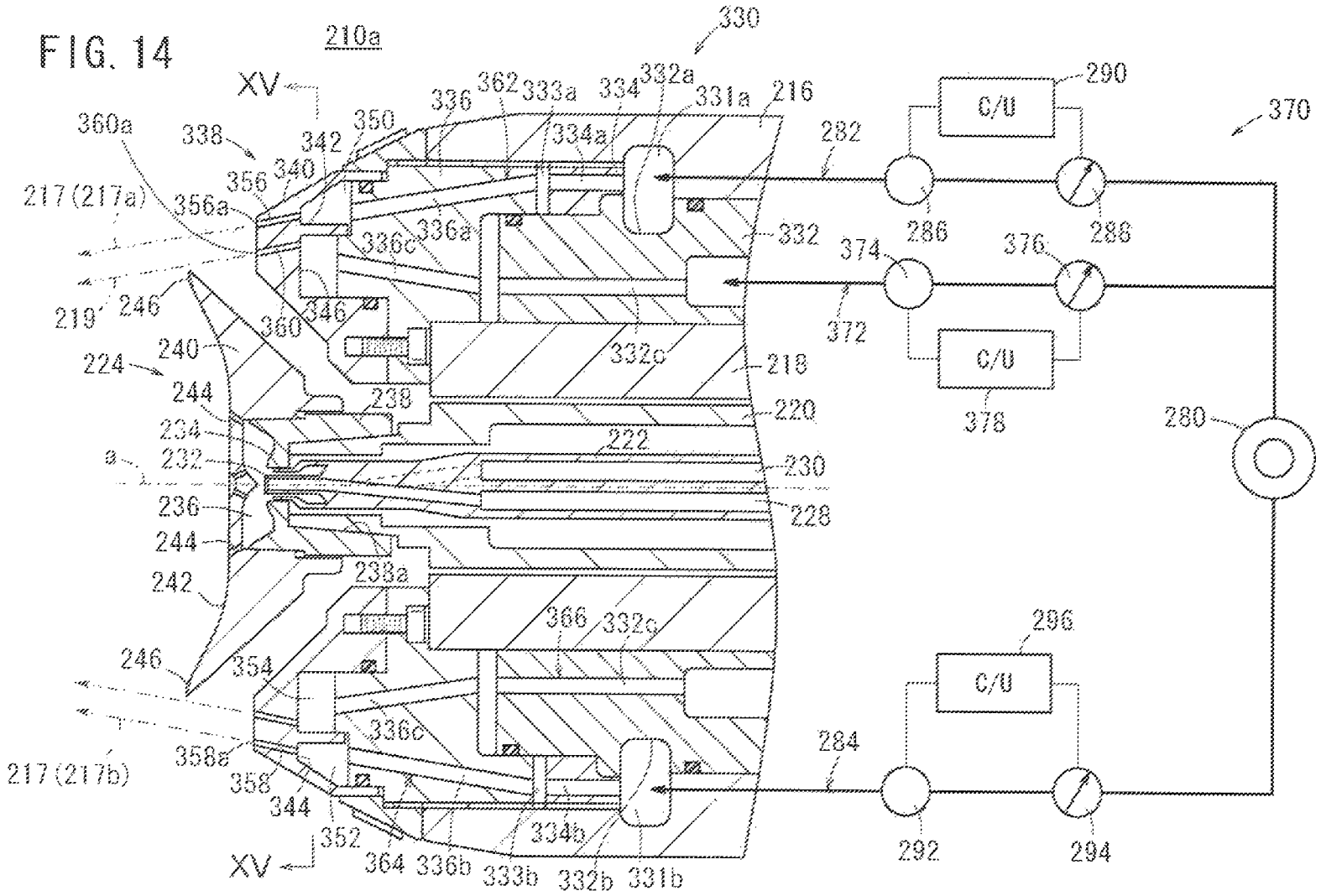
FIG. 14 shows a schematic configuration of a coating apparatus according to a fourth exemplary embodiment.
Figure 15:
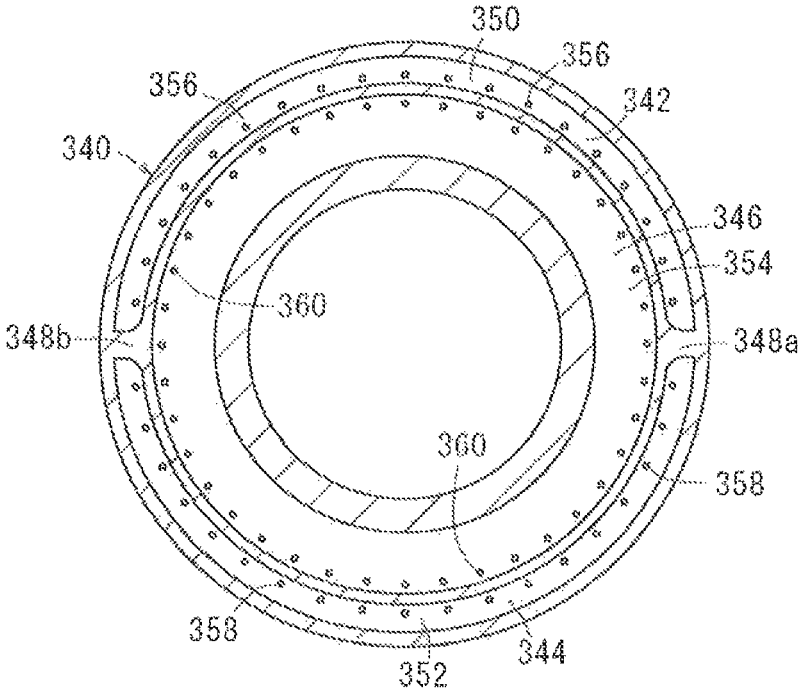
FIG. 15 is a sectional view taken along a line XV-XV of FIG. 14.

FIG. 14 shows a schematic configuration of a coating apparatus 210*a* according to a fourth exemplary embodiment. FIG. 15 is a cross sectional view taken along a as line XV-XV of FIG. 14 (the rotary atomizing head 224 is not shown). Meanwhile, in the coating apparatus 210*a* according to the fourth exemplary embodiment, the elements exhibiting the same functions and effects as the coating apparatus 210 of the third exemplary embodiment are indicated with the same reference numerals and the detailed descriptions thereof are omitted.

In a coating gun 330 configuring a main body of the coating apparatus 210*a*, a plurality of ring-shaped flow path forming members 332, 334, 336 (three, in the shown example) is disposed between the casing 216 and the air motor 218. Hereinafter, the flow path forming members 332, 334, 336 are referred to as 'first flow path forming member 332', 'second flow path forming member 334' and 'third flow path forming member 336', respectively.

The first flow path forming member 332 is disposed at the outside of the air motor 218 and is formed at an outer peripheral portion thereof with concave portions 332*a*, 332*b*. A plurality of flow paths 332*c* penetrating in an axial line direction is circumferentially formed at an interval. The second flow path forming member 334 is disposed between the first flow path forming member 332 and the casing 216 and is formed with a plurality of flow paths 334*a*, 334*b* penetrating in the axial line direction. Annular spaces 331*a*, 331 that are independent each other are formed by the first flow path forming member 332, the second flow path forming member 334 and the casing 216.

The third flow path forming member 336 is disposed between the casing 216 and the first flow path forming member 332 and also at the front of the first flow path forming member 332 and the second flow path forming member 334. The third flow path forming member 336 is formed with a flow path 336*a* communicating with one flow path 334*a* of the second flow path forming member 334, a flow path 336*b* communicating with the other flow path 334*b* of the second flow path forming member 334 and a plurality of flow paths 336*c* communicating with the flow paths 332*c* of the first flow path forming member 332. Two spaces 333*a*, 333*b* that are air-tightly partitioned by partition walls (not shown) are formed between the second flow path forming member 334 and the third flow path forming member 336.

A ring member 340 configuring an air injecting unit 338 is fixed to a front end of the third flow path forming member 336 concentrically with the rotary atomizing head 224 so that it surrounds the bell cup 240 at the rear side of the bell cup 240. The ring member injects the shaping air 217 from the rear of an outer peripheral edge portion of the bell cup 240 towards the outer peripheral edge portion.

The ring member 340 is formed at its backside with a first arc-shaped concave portion 342, a second arc-shaped concave portion 344 and an annular concave portion 346. The first arc-shaped concave portion 342 and the second arc-shaped concave 25S portion 344 are partitioned by partition walls 348*a*, 348*b* (refer to FIG. 15) and have the substantially same volume. The annular concave portion 346 is formed at the inside of the first arc-shaped concave portion 342 and the second arc-shaped concave portion 344 with regard to a radial direction.

A first arc-shaped buffer chamber 350 is formed by the first arc-shaped concave portion 342 and a front face of the third flow path forming member 336. A second arc-shaped buffer chamber 352 is formed by the second arc-shaped concave portion 344 and the front face of the third flow path forming member 336. A third arc-shaped buffer chamber 354 is formed by the annular concave portion 346 and the front face of the third flow path forming member 336.

The ring member 340 is further formed with a plurality of first air supplying holes 356 communicating the first buffer chamber 350 and a front face of the ring member 340, a plurality of second air supplying holes 358 communicating the second buffer chamber 352 and the front face of the ring member 340 and a plurality of third air supplying holes 360 communicating the third buffer chamber 354 and the front face of the ring member 340.

The first air supplying holes 356 are provided at an equal interval in the circumferential direction about the axial line "a". The first air supplying hole is opened at its one end (rear end) in the first buffer chamber 350 and is opened at its other end (front end) as a first air injecting port 356*a* in the front face. The second air supplying holes 358 are provided at an equal interval in the circumferential direction about the axial line "a". The second air supplying hole is opened at its one end (rear end) in the second buffer chamber 352 and is opened at its other end (front end) as a second air injecting port 358*a* in the front face. The third air supplying holes 360 are provided at an equal interval in the circumferential direction about the axial line "a". The third air supplying hole is opened at its one end (rear end) in the third buffer chamber 354 and is opened at its other end (front end) as a third air injecting port (inner side air injecting port) 360*a* in the front face.

The first air supplying holes 356 and the second air supplying holes 358 are circumferentially provided at an equal interval on the same periphery and are a little inclined to be close to the axial line "a" of the rotary atomizing head 224 towards the front. The third air supplying holes 360 are circumferentially provided at an equal interval at the inside of the first air supplying holes 356 and the second air supplying holes 358, are a little inclined to be close to the axial line "a" of the rotary atomizing head 224 towards the front and are opened towards the outer peripheral edge portion of the bell cup 240.

Also, the first air supplying holes 356, the second air supplying holes 358 and the third air supplying holes 360 are inclined relative to the axial line "a" by a predetermined angle (for example, 30 to 50 degrees) in the circumferential direction.

In the coating gun 330 shown in FIG. 14, a first air supplying channel 362 is configured by the space 331*a*, the one flow path 334*a* of the second flow path forming member 334, the flow path 336*a* of the third flow path forming member 336, the first buffer chamber 350 and the first air supplying holes 356. A second air supplying channel 364 is configured by the other flow path 334*b* of the second flow path forming member 334, the flow path 336*b* of the third flow path forming member 336, the second buffer chamber 352 and the second air supplying holes 358. A third air supplying channel 366 is formed by the flow path 332*c* of the first flow path forming member 332, the flow path 336*c* of the third flow path forming member 336, the third buffer chamber 354 and the third air supplying holes 360.

An air supplying system 370 has a third air line 372, a third flow meter 376, a third electro-pneumatic converter 374 and a third air control unit 378, in addition to the air supplying system 214 shown in FIG. 9. The third flow meter 376 and the third electro-pneumatic converter 374 are disposed on the third air line 372, and the third air control unit 378 controls the electro-pneumatic converter 374 so that a flow rate of the air to be supplied to the third air supplying channel 366 becomes a predetermined flow rate, by using a flow rate value detected in the third flow meter 376 as a feedback value.

The compressed air that is supplied to the coating gun 330 by the first air line 282 passes through the first air supplying channel 362 and is then injected from the first air injecting ports 356*a*, as the first air 217*a*. The compressed air that is supplied to the coating gun 330 by the second air line 284 passes through the second air supplying channel 364 and is then injected from the second air injecting ports 358*a*, as the second air 217*b*. The compressed air that is supplied to the coating gun 330 by the third air line 372 passes through the third air supplying channel 366 and is then injected from the third air injecting ports 360*a*, as annular inner side shaping air 219.

In the coating apparatus 210*a*, the first air 217*a* that is injected from the first air injecting ports 356*a* configures predetermined areas of the shaping air 217 in a circumferential direction and has relatively high wind speed. The second air 217*b* that is injected from the second air injecting ports 358*a* configures predetermined other areas of the shaping air 217 in the circumferential direction and has relatively low wind speed. That is, the wind speed (flow speed) of the first air 217*a* is higher than the wind speed (flow speed) of the second air 217*b*. Hence, the first flow rate that is controlled by the first electro-pneumatic converter 286 is set to be larger than the second flow rate that is controlled by the second electro-pneumatic converter 292.

During painting by the coating apparatus 210*a* configured as descried above, the rotational shaft 220 is rotated at high speed by the air motor 218. And, the paint is discharged towards the paint storage 236 of the rotary atomizing head 224 from the paint supplying nozzle 232. Thereby, the paint is thinned on the paint discharging face, and thereafter, subdivided in the grooves 246 to be discharged as liquid threads from the outer peripheral end of the bell cup 240 and to be atomized as paint particles.

At this time, since the inner side shaping air 219 is injected from the third air injecting ports 360*a* towards the outer peripheral edge portion of the bell cup 240, the atomization of the paint is promoted by the inner side shaping air 219. The electrified paint particles having been atomized fly towards the work to coat the work. The sprayed pattern of the paint at this time is pattern-molded by the inner side shaping air 219 that is injected from the third air injecting ports 360*a* and the shaping air 217 (first air 217*a* and second air 217*b*) that is injected from the first air injecting ports 356*a* and the second air injecting ports 358*a*.

As described above, according to the coating apparatus 210*a* of the fourth exemplary embodiment, the first air 217*a* of relatively high wind speed is injected from the first air injecting ports 356*a* and the second air 217*b* of relatively low wind speed is injected from the second air injecting ports 358*a*. Hence, like the coating apparatus 210 of the third exemplary embodiment, it is possible to form a coating pattern having a center "c" that is a position deviated from the axial line "a" of the rotary atomizing head 224. Accordingly, even when the coating is performed with the axial line "a" of the rotary atomizing head 224 being inclined to the part to be coated, not being perpendicular thereto, it is possible to perform the coating by using a part of the coating pattern having a larger amount of coating, thereby effectively performing the coating.

In the fourth exemplary embodiment, the inner side shaping air 219 is injected towards the outer peripheral edge portion of the bell cup 240 at the inside of the first air 217*a* and the second air 217*b*, in addition to the first air 217*a* and the second air 217*b* for controlling the center position of the coating pattern. Hence, it is possible to control the center position of the coating pattern and to atomize the paint, effectively and securely. That is, since the inner side shaping air 219 is enabled to atomize the paint and the first air 217*a* and the second air 217*b* are enabled to displace the center "c" of the coating pattern, it is possible to effectively implement the respective functions.

In this case, the wind speed of the first air 217*a* is set to be higher than that of the inner side shaping air 219, so that it is possible to effectively attract the inner side shaping air 219 towards the first air 217*a* by the first air 217*a* of relatively high wind speed. As a result, it is possible to control the center position of the coating pattern, more securely. For example, it is preferable to set the wind speed of the first air 217*a* to be 150% or larger of the wind speed of the inner side shaping air 219, for example.

In the shown example, the first air injecting ports 356*a* are configured by the plurality of holes, which are provided to the ring member 340 at an interval in the circumferential direction. Instead of this configuration, the first air injecting ports may be configured by arc-shaped holes (slits) extending in the circumferential direction. Likewise, the second air injecting ports 358*a* are configured by the plurality of holes, which are provided to the ring member 340 at an interval in the circumferential direction. Instead of this configuration, the second air injecting ports may be configured by arc-shaped holes (slits) extending in the circumferential direction.

In the shown example, the third air injecting ports 360*a* are configured by the plurality of holes, which are provided to the ring member 340 at an interval in the circumferential direction. Instead of this configuration, the third air injecting ports may be configured by ring-shaped holes (slits) extending in the circumferential direction.

The ring member 340 has the two arc-shaped concave portions (first arc-shaped concave portion 342 and second arc-shaped concave portion 344). However, the ring member may have three or more arc-shaped concave portions, in imitation of the ring members 310, 320 shown in FIGS. 13A and 13B.

Needless to say, in the fourth exemplary embodiment, regarding the respective constitutional parts common to the third exemplary embodiment, it is possible to obtain the same or equivalent operations and effects as or to those by the common constitutional parts of the third exemplary embodiment.

Although the specific embodiments and the modifications have been described as examples of the invention, the invention is not limited thereto and a variety of modifications/changes can be made without departing from the gist of the invention.

In accordance with the above embodiments and modifications, a coating method, in which a paint discharged from a rotary atomizing head is directed towards a work by an annular shaping air so as to coat the work, may include: injecting, as a first air, a predetermined portion of the shaping air at relatively high wind speed; and injecting, as a second air, the other portion of the shaping air at relatively low wind speed compared to that of the first air, while injecting the first air.

The method may further include: attracting the second air towards the first air to displace a part of the second air towards a rotational axis of the rotary atomizing head; and forming a substantially circular coating pattern having a center on the rotational axis of the rotary atomizing head.

According to this method, it is possible to displace the second air towards the rotational axis of the rotary atomizing head by attracting the second air of relatively low wind speed towards the first air of relatively high wind speed. Thereby, while keeping the substantially circular shape of the coating pattern, it is possible to reduce a non-coated part, which is caused in a vicinity of the rotational axis of the rotary atomizing head. Therefore, it is possible to obtain a coating film having a uniform film thickness without enlarging a member for injecting the shaping air while securing a degree of freedom of moving of the coating gun when recoating the coating pattern.

In the method, a portion of the shaping air in a circumferential direction may configure the first air, the other portion in the circumferential direction may configure the second air. A circumferential range within which the first air is formed may be smaller than a circumferential range within which the second air is formed.

Thereby, it is possible to effectively displace the second air towards the rotational axis of the rotary atomizing head when attracting the second air towards the first air.

In the coating method, the second air may be annularly formed and the first air may be formed only in a part of the circumferential range at an inside of the second air.

By forming the first air at the inside of the second air, it is possible to displace the second air towards the rotational axis of the rotary atomizing head more effectively, thereby making the coating film thickness uniform.

In the coating method, the first air may be formed by a plurality of areas provided at an equal interval in a circumferential direction.

By forming the first air at the locations spaced at an equal interval in the circumferential direction, it is possible to displace the second air towards the first air with good balance. Thus, it is possible to effectively reduce the non-coated part of the coating pattern and to thus make the coating film thickness further uniform.

In addition, in accordance with the above embodiments and modifications, a coating apparatus 10, 10*a* may include: a rotary atomizing head 24 that discharges a paint to a work;

and an air injecting unit 26, 138 that injects an annular shaping air towards an outer peripheral edge portion of the rotary atomizing head 24. The air injecting unit 26, 138 may include: first air injecting ports 73*a*, 158*a*, 160*a*; and second air injecting ports 73*b*, 156*a*. The air injecting unit may be configured to inject a first air of relatively high wind speed from the first air injecting ports and to inject a second air of relatively low wind speed from the second air injecting ports.

In the apparatus 10, 10*a*, the air injecting unit 26, 138 may further include a plurality of buffer chambers 64, 66, 150, 152, 154 that are provided upstream from the first air injecting ports and the second air injecting ports and are partitioned by the partition walls. In order to form the substantially circular coating pattern having a center on the rotational axis "a" of the rotary atomizing head 24, the air injecting unit 26, 138 may be configured to inject the first air of relatively high wind speed from the first air injecting ports 73*a*, 158*a*, 160*a* and to inject the second air of relatively low wind speed from the second air injecting ports 73*b*, 156*a*, thereby attracting the second air towards the first air and thus displacing a portion of the second air towards the rotational axis of the rotary atomizing head.

According to this apparatus, it is possible to displace the second air towards the rotational axis of the rotary atomizing head by attracting the second air of relatively low wind speed towards the first air of relatively high wind speed. Thereby, while keeping the substantially circular shape of the coating pattern, it is possible to reduce a non-coated part, which is caused in the vicinity of the rotational axis of the rotary atomizing head, and to thus make a coating film having a uniform film thickness.

In the apparatus 10, the first air injecting ports 73*a* may be provided to enable a portion of the shaping air in a circumferential direction to configure the first air. The second air injecting ports 73*b* may be provided to enable the other portion of the shaping air in the circumferential direction to configure the second air. A circumferential range within which the first air injecting ports 73*a* are provided may be smaller than a circumferential range within which the second air injecting ports 73*b* are provided.

Thereby, it is possible to effectively displace the second air towards the rotational axis of the rotary atomizing head when attracting the second air towards the first air.

In the apparatus 10, the buffer chambers 64, 66 may be circumferentially partitioned by the partition walls 64*a*, 64*b*, 114, 124. The first air supplying holes 71*a* communicating the first air injecting ports and the buffer chamber may be provided in the vicinity of the partition walls 64*a*, 64*b*, 114, 124. The second air supplying holes 71*b* communicating the second air injecting ports and the buffer chamber may be provided at the positions more distant from the partition walls 64*a*, 64*b*, 114, 124 in the circumferential direction than the first air supplying holes 71*a*.

Thereby, the wind speed of the first air that is injected from the first air injecting ports is increased. Also, since the air flow rates to be supplied to the respective buffer chambers are preferably the same, it is sufficient to provide one air supplier, so that it is possible to simplify the configuration of the apparatus.

In the apparatus 10*a*, the second air injecting ports 156*a* may be provided to make the second air annular. The first air injecting ports 158*a*, 160*a* may be provided to form the first air only in a part of the circumferential range of the second air at an inside of the second air.

In this configuration, by injecting the first air from the inside of the second air, it is possible to displace the second air towards the rotational axis of the rotary atomizing head more effectively, thereby making the coating film thickness uniform.

In the apparatus 10, 10*a*, the first air injecting ports 73*a*, 158*a*, 160*a* may be provided to form the first air by a plurality of areas that is provided at an equal interval in a circumferential direction.

By injecting the first air at the locations spaced at an equal interval in a circumferential direction, it is possible to displace the second air towards the first air with good balance. Thus, it is possible to effectively reduce the non-coated part of the coating pattern and to thus make the coating film thickness further uniform.

Moreover, in accordance with the above embodiments and modifications, a coating method in which a paint discharged from a rotary atomizing head is directed towards a work by an annular shaping air so as to coat the work may include a process of injecting, as first air, a predetermined portion of the shaping air at relatively high wind speed and a process of injecting, as second air, the other portion of the shaping air at relatively low wind speed, compared to that of the first air, while injecting the first air. A portion of the shaping air configuring a predetermined area in a circumferential direction may configure the first air. A portion of the shaping air configuring the other area in the circumferential direction may configure the second air.

According to this method, a flow speed of the portion of the shaping air that is annularly injected is made to be higher than that of the other portion, so that the coating pattern can be displaced towards the first air of the fast portion. As a result, it is possible to form a coating pattern having a center that is a position deviated from the rotational axis of the rotary atomizing head. Accordingly, even when the coating is performed with the rotational axis of the rotary atomizing head being inclined to a part to be painted, not being perpendicular thereto, it is possible to perform the coating by using a part of the coating pattern having a larger amount of coating, thereby effectively performing the coating.

In the above method, the wind speed of the first air may be 140% or smaller of the wind speed of the second air.

By setting the wind speeds like that, it is possible to uniformly perform the coating without splitting the coating pattern.

In the above method, the inner side shaping air may be injected towards the outer peripheral edge portion of the rotary atomizing head at the inside of the first air and the second air.

By doing so, it is possible to inject the inner side shaping air towards the outer peripheral edge portion of the bell cup at the inside of the first air and the second air, in addition to the injecting of the first air and the second air for controlling the center position of the coating pattern. Hence, it is possible to control the center position of the coating pattern and to atomize the paint, effectively and securely.

Moreover, in accordance with the above embodiments and modifications, a coating apparatus 210, 210*a* may include: a rotary atomizing head 224 that discharges a paint to a work; and an air injecting unit 226, 338 that injects an annular shaping air towards an outer peripheral edge portion of the rotary atomizing head 224. The air injecting unit 226, 238 may include first air injecting ports 268*a*, 356*a* and second air injecting ports 270*a*, 358*a*. The air injecting unit may be configured to inject the first air of relatively high wind speed from the first air injecting ports and to inject the second air of relatively low wind speed from the second air injecting ports. The first air injecting ports 268*a*, 356*a* may be configured to inject the first air from a portion of the shaping air configuring a predetermined area in a circumferential direction. The second air injecting ports 270*a*, 358*a* may be configured to inject the second air from a portion of the shaping air configuring the other area in the circumferential direction.

According to this apparatus, it is possible to form a coating pattern having a center deviated from the rotational axis of the rotary atomizing head. Accordingly, even when the coating is performed with the axial line of the rotary atomizing head being inclined to a part to be painted, not being perpendicular thereto, it is possible to effectively perform the coating.

In the above apparatus 210, 210*a*, the air injecting unit 226, 338 may have the to plurality of buffer chambers 264, 266, 350, 352, 354 that is circumferentially partitioned, the first air supplying holes 268, 256 communicating at least one of the buffer chambers and the first air injecting ports 268*a*, 356*a* and the second air supplying holes 270, 358 communicating the other buffer chambers and the second air injecting ports 270*a*, 358*a*.

According to this apparatus, it is possible to securely inject the shaping air having different wind speeds by supplying the air of relatively high flow rate to the buffer chamber corresponding to the first air injecting ports and supplying the air of relatively low flow rate to the other buffer chambers corresponding to the second air injecting ports.

In the above apparatus 210, 210*a*, the wind speed of the first air may be 140% or smaller of the wind speed of the second air.

By setting the wind speeds like that, it is possible to uniformly perform the coating without splitting the coating pattern.

In the above apparatus 210*a*, the air injecting unit 338 may further have the inner side air injecting ports 360*a* that inject the inner side shaping air towards the outer peripheral edge portion of the rotary atomizing head 224, at the inside of the first air injecting ports 356*a* and the second air injecting ports 358*a*.

According to this apparatus, it is possible to inject the inner side shaping air towards the outer peripheral edge portion of the bell cup at the inside of the first air and the second air, in addition to the injecting of the first air and the second air for controlling the center position of the coating pattern. Hence, it is possible to control the center position of the coating pattern and to atomize the paint, effectively and securely.

According to the coating method and the coating apparatus of the above exemplary embodiments, it is possible to reduce a non-coated part, which is caused in the vicinity of the rotational axis of the rotary atomization head, and to thus obtain a coating film having a uniform film thickness without enlarging a member for injecting the shaping air while securing a degree of freedom of moving of the coating gun when recoating a coating pattern.

Also, according to the coating method and the coating apparatus of the above exemplary embodiments, even when the coating is performed with the coating gun being obliquely disposed relative to the part to be painted, it is possible to effectively perform the coating.

DESCRIPTION OF REFERENCE NUMERALS

10, 10*a*: coating apparatus
17: shaping air
17*a*: first air
17*b*: second air
24: rotary atomizing head
26: air injecting unit
73*a*, 158*a*, 160*a*: first air injecting port
73*b*, 156*a*: second air injecting port
210, 210*a*: coating apparatus
217: shaping air
217*a*: first air
217*b*: second air
219: inner side shaping air
224: rotary atomizing head
226: air injecting unit
264, 350: first buffer chamber
266, 352: second buffer chamber
268, 356: first air supplying hole
268*a*, 356*a*: first air injecting port
270, 358: second air supplying hole
270*a*, 358*a*: second air injecting port
360*a*: third air injecting port

What is claimed is:

1. A coating apparatus comprising:

a rotational shaft:

a rotary drive device configured to rotate the rotational shaft:

a rotary atomizing head attached to the rotational shaft and configured to thin a paint by a centrifugal force resulting from a rotation of the rotary atomizing head and to discharge the paint from an outer peripheral edge portion of the rotary atomizing head to a work; and an air injecting unit that injects annular shaping air towards the outer peripheral edge portion of the rotary atomizing head, wherein the air injecting unit includes a first air injecting port and a second air injecting port, wherein the air injecting unit is configured to inject a first air of relatively high wind speed from the first air injecting port and to inject a second air of relatively low wind speed from the second air injecting port, wherein the air injecting unit further includes a plurality of buffer chambers that is provided upstream from the first air injecting port and the second air injecting port and is partitioned by a partition wall, and wherein the air injecting unit is configured to attract the second air towards the first air and to displace a part of the second air towards a rotational axis of the rotary atomizing head so as to form a substantially circular coating pattern having a center on the rotational axis of the rotary atomizing head, by injecting the first air of relatively high wind speed from the first air injecting port and injecting the second air of relatively low wind speed from the second air injecting port.

2. The coating apparatus according to claim 1, wherein the first air injecting port is provided such that a part of the shaping air in a circumferential direction configures the first air, wherein the second air injecting port is provided such that the other part of the shaping air in the circumferential direction configures the second air, and wherein a circumferential range within which the first air injecting port is provided is smaller than a circumferential range within which the second air injecting port is provided.

3. The coating apparatus according to claim 1, wherein the buffer chambers are circumferentially partitioned by the partition wall, wherein a first air supplying hole communicating the first air injecting port and the buffer chamber are provided in a vicinity of the partition wall, and wherein a second air supplying hole communicating the second air injecting port and the buffer chamber are provided at a position more distant from the partition wall in the circumferential direction than the first air supplying hole.

4. The coating apparatus according to claim 1, wherein the second air injecting port is provided to make the second air annular, and wherein the first air injecting port is provided to form the first air only in a part of the circumferential range at an inside of the second air.

5. The coating apparatus according to claim 1, wherein the first air injecting port is provided to form the first air at a plurality of areas that are provided at an equal interval in a circumferential direction.

6. The coating apparatus according to claim 1, wherein the first air injecting port is configured to inject the first air from a portion of the shaping air configuring a predetermined area in a circumferential direction, and wherein the second air injecting port is configured to inject the second air from a portion of the shaping air configuring the other area in the circumferential direction.

7. A coating apparatus comprising:

a rotational shaft a rotary drive device configured to rotate the rotational shaft:

a rotary atomizing head attached to the rotational shaft and configured to thin a paint by a centrifugal force resulting from a rotation of the rotary atomizing head and to discharge the paint from an outer peripheral edge portion of the rotary atomizing head to a work; and an air injecting unit that injects annular shaping air towards the outer peripheral edge portion of the rotary atomizing head, wherein the air injecting unit includes a first air injecting port and a second air injecting port, wherein the air injecting unit is configured to inject a first air of relatively high wind speed from the first air injecting port and to inject a second air of relatively low wind speed from the second air injecting port, wherein the first air injecting port is configured to inject the first air from a portion of the shaping air configuring a predetermined area in a circumferential direction, and wherein the second air injecting port is configured to inject the second air from a portion of the shaping air configuring the other area in the circumferential direction, and wherein the air injecting unit includes a plurality of buffer chambers that are circumferentially partitioned, a first air supplying hole communicating at least one of the buffer chambers and the first air injecting port and second air supplying hole communicating the other buffer chambers and the second air injecting port.

8. The coating apparatus according to claim 7, wherein a wind speed of the first air is 140% or smaller of a wind speed of the second air.

9. The coating apparatus according to claim 7, wherein the air injecting unit further includes an inner side air injecting port that injects an inner side shaping air towards the outer peripheral edge of the rotary atomizing head, at an inside of the first air injecting port and the second air injecting port.

10. The coating apparatus according to claim 7, wherein the air injecting unit is configured to inject the first air of relatively high wind speed from the first air injecting port and to inject the second air of relatively low wind speed from the second air injecting port such that the second air is deviated towards a rotational axis of the rotary atomizing head.

* * * * *